US011495203B2

(12) United States Patent
Ishida et al.

(10) Patent No.: US 11,495,203 B2
(45) Date of Patent: Nov. 8, 2022

(54) SOUND ABSORBER, ELECTRONIC DEVICE WITH SOUND ABSORBING DEVICE, AND IMAGE FORMING APPARATUS WITH SOUND ABSORBER

(71) Applicants: Masahiro Ishida, Kanagawa (JP); Naoki Matsuda, Kanagawa (JP); Hiroshi Ishii, Kanagawa (JP); Kohta Takenaka, Kanagawa (JP); Keisuke Shimizu, Tokyo (JP); Shogo Sakamoto, Kanagawa (JP); Takayuki Isaka, Kanagawa (JP)

(72) Inventors: Masahiro Ishida, Kanagawa (JP); Naoki Matsuda, Kanagawa (JP); Hiroshi Ishii, Kanagawa (JP); Kohta Takenaka, Kanagawa (JP); Keisuke Shimizu, Tokyo (JP); Shogo Sakamoto, Kanagawa (JP); Takayuki Isaka, Kanagawa (JP)

(73) Assignee: Ricoh Company, LTD., Tokyo (JP)

( * ) Notice: Subject to any disclaimer, the term of this patent is extended or adjusted under 35 U.S.C. 154(b) by 397 days.

(21) Appl. No.: 16/701,814

(22) Filed: Dec. 3, 2019

(65) Prior Publication Data

US 2020/0105237 A1 Apr. 2, 2020

Related U.S. Application Data

(63) Continuation of application No. 15/415,058, filed on Jan. 25, 2017, now Pat. No. 10,540,953.

(30) Foreign Application Priority Data

Jan. 29, 2016 (JP) ..... 2016-015890
Nov. 29, 2016 (JP) ..... 2016-231140

(51) Int. Cl.
*G10K 11/172* (2006.01)
*G03G 21/16* (2006.01)
*G03G 21/00* (2006.01)

(52) U.S. Cl.
CPC ..... *G10K 11/172* (2013.01); *G03G 21/1619* (2013.01); *G03G 21/00* (2013.01)

(58) Field of Classification Search
CPC ... G10K 11/172; G03G 21/1619; G03G 21/00
See application file for complete search history.

(56) References Cited

U.S. PATENT DOCUMENTS 3,821,999 A 7/1974 Guess et al.
4,068,736 A 1/1978 Dean et al.
(Continued)

FOREIGN PATENT DOCUMENTS

JP H10-91171 A 4/1998
JP 2000-077858 A 3/2000
(Continued)

OTHER PUBLICATIONS

Office Action dated Jul. 31, 2020 in Japanese Application No. 2016-231140.

*Primary Examiner* — Forrest M Phillips
(74) *Attorney, Agent, or Firm* — Harness, Dickey & Pierce, P.L.C.

(57) ABSTRACT

A sound absorber includes at least one cavity and at least one mouth to communicate the at least one cavity with an outside of the sound absorber. The at least one cavity includes a top surface, a bottom surface, and a side wall. The top surface includes the mouth. The bottom surface opposes the top surface. The side wall is extended to connect the top surface with the bottom surface. At least one of the top surface and the bottom surface is inclined with respect to the side wall.

12 Claims, 17 Drawing Sheets

(56) References Cited

U.S. PATENT DOCUMENTS

| | | | | |
|---|---|---|---|---|
| 4,296,831 | A | 10/1981 | Bennett | |
| 4,330,047 | A * | 5/1982 | Ruspa | F24F 13/24 454/906 |
| 5,121,811 | A | 6/1992 | Shima et al. | |
| 6,199,657 | B1 | 3/2001 | Misawa et al. | |
| 7,835,659 | B2 | 11/2010 | Moro et al. | |
| 2006/0050346 | A1 | 3/2006 | Kim | |
| 2008/0078611 | A1 | 4/2008 | Inoue et al. | |
| 2010/0078258 | A1 * | 4/2010 | Tanabe | H05K 7/20718 181/224 |
| 2016/0033928 | A1 * | 2/2016 | Ishimitsu | G10K 11/002 399/110 |
| 2016/0152041 | A1 | 6/2016 | Ishida et al. | |
| 2016/0161904 | A1 | 6/2016 | Matsuda et al. | |
| 2016/0221772 | A1 | 8/2016 | Ishida et al. | |
| 2016/0225363 | A1 | 8/2016 | Ishida et al. | |
| 2016/0349695 | A1 | 12/2016 | Ishida et al. | |

FOREIGN PATENT DOCUMENTS

| | | | |
|---|---|---|---|
| JP | 2000-112306 | A | 4/2000 |
| JP | 2005-313835 | A | 11/2005 |
| JP | 2008-090931 | A | 4/2008 |
| JP | 2010087174 | A | 4/2010 |
| JP | 2014157720 | A | 8/2014 |
| JP | 2015179837 | A | 10/2015 |
| JP | 2016033646 | A | 3/2016 |
| WO | WO-2012008225 | A1 | 1/2012 |

* cited by examiner

SOUND ABSORBER, ELECTRONIC DEVICE WITH SOUND ABSORBING DEVICE, AND IMAGE FORMING APPARATUS WITH SOUND ABSORBER

CROSS-REFERENCE TO RELATED APPLICATIONS

This patent application is a continuation application of U.S. application Ser. No. 15/415,058, filed on Jan. 25, 2017, which is based on and claims priority pursuant to 35 U.S.C. 119(a) to Japanese Patent Application Nos. 2016-015890 filed on Jan. 29, 2016, and 2016-231140 filed on Nov. 29, 2016 in the Japan Patent Office, the entire disclosures of each of which are hereby incorporated by reference herein.

BACKGROUND

Technical Field

This disclosure relates to a sound absorber, an electronic device with the sound absorber, and an image forming apparatus with the sound absorber.

Related Art

To suppress leakage of a drive sound, image forming apparatuses typically employ a sound absorber employing a Helmholtz resonator. The sound absorber includes a cavity and a mouth that links the cavity to the outside of the sound absorber.

SUMMARY

An aspect of the present disclosure provides a sound absorber that includes at least one cavity and at least one mouth to communicate the at least one cavity with an outside of the sound absorber. The at least one cavity includes a top surface, a bottom surface, and a side wall. The top surface includes the mouth. The bottom surface opposes the top surface. The side wall is extended to connect the top surface with the bottom surface. At least one of the top surface and the bottom surface is inclined with respect to the side wall.

Another aspect of the present disclosure provides an electronic device An electronic device includes a sound source and the sound absorber. The sound source generates sound. The sound absorber absorbs the sound generated by the sound source.

Yet another aspect of the present disclosure provides an image forming apparatus including at least one image forming unit. The at least one image forming unit includes the electronic device.

Still yet another aspect of the present disclosure provides an electronic device that includes a frame, a sound absorber, a drawing unit, and a drawing unit exterior member. The sound absorber absorbs sound generated in the electronic device. The sound absorber has a cavity and an opening to communicate the cavity with an outside of the electronic device. The drawing unit is withdrawably inserted in the frame. The drawing unit exterior member is part of an exterior of the electronic device, to cover a front end of the drawing unit in a direction in which the drawing unit is drawn. The cavity of the sound absorber is disposed in of the drawing unit exterior member.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

DETAILED DESCRIPTION

In general, range of choices regarding positioning of a sound absorber with a Helmholtz resonator in an image forming apparatus is limited. However, according to one embodiment of the present disclosure, the sound absorber with a Helmholtz resonator can be disposed even in a narrow space inside the image forming apparatus.

Figure 2:
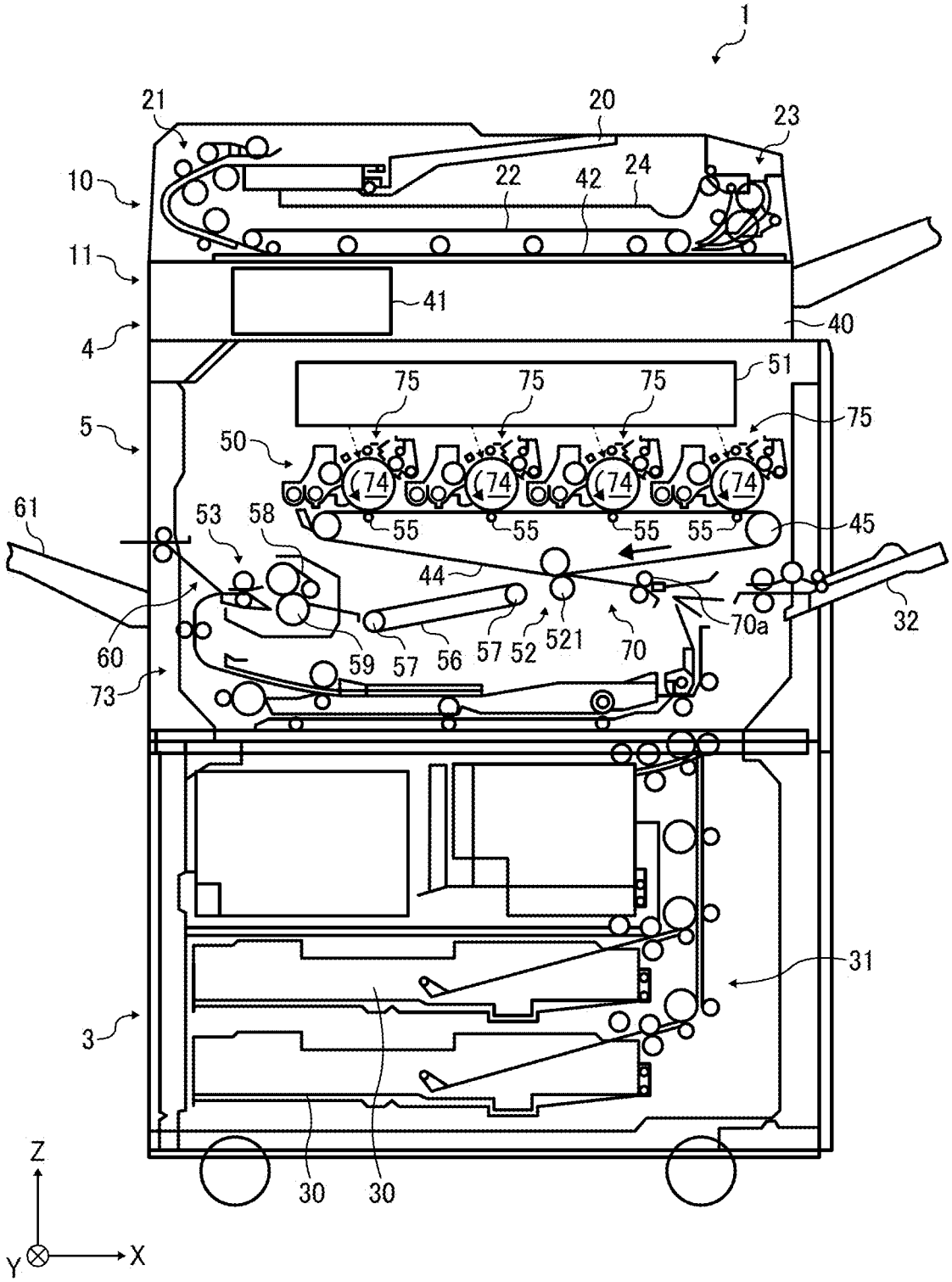
FIG. 2 is a front view schematically illustrating an exemplary copier according to one embodiment of the present disclosure.

Referring now to the drawings, wherein like reference numerals designate identical or corresponding members throughout the several views of the drawings, and in particular to FIG. 2, an exemplary image forming apparatus (e.g., a copier 1), to which the present disclosure is applied, is briefly described, initially. As shown there, directions of the copier 1 are defined by coordinate axes xyz, respectively, for the sake of easy comprehension of the present disclosure. That is, the coordinate axis x represents a widthwise direction of the copier 1, the coordinate axis y represents a depth direction of the copier 1, and the coordinate axis z represents a height direction of the copier 1 as well.

That is, FIG. 2 is a front view schematically illustrating an exemplary copier 1 according to one embodiment of the present disclosure. As shown there, the copier 1 is a tandem color copier. The copier 1 is constituted by an apparatus body or frame 11 and an automatic original document feeder (hereafter simply referred to as an ADF) 10. The apparatus frame 11 contains an image forming unit 5 to form images on sheets acting as recording media, a sheet feeding unit 3 to feed sheets toward the image forming unit 5, and an image reading unit 4.

The ADF 10 includes an original document tray 20, multiple original document feeding rollers 21, an original document conveying belt 22, an original document ejecting roller 23, and an original document ejecting tray 24. The ADF 10 is attached the image reading unit 4 and is freely openably closable with respect to the image reading unit 4. The image reading unit 4 is configured by including a read housing 40, an optical scanning unit 41, and a contact glass 42.

The sheet feeding unit 3 includes three sheet cassettes 30 and a sheet feeder 31. These three sheet cassettes 30 accommodate sheets of different sizes as recording media. The sheet feeder 31 conveys sheets stored in the sheet cassettes 30 to a main sheet conveying path 70 disposed in the image forming unit 5. To a side of the image forming unit 5, a manual sheet feeding tray 32 is attached and is opened and closed from and to the image forming unit 5 when rotated around a rotary shaft disposed in a body of the copier 1. Hence, when the manual sheet feeding tray 32 is opened, a topmost sheet in a bunch of sheets manually set on an upper surface of the manual sheet feeding tray 32 is launched by a sheet sending roller toward the main sheet conveying path 70. In the main sheet conveying path 70, a pair of registration rollers 70*a* is disposed. After it sandwiches a sheet delivered in the main sheet conveying path 70 between two rollers, the pair of registration rollers 70*a* sends the sheet toward a secondary transfer nip at a given time.

The image forming unit 5 includes an exposing unit 51, a tandem image forming unit 50, and an intermediate transfer belt 44. Also included in the image forming unit 5 are multiple primary transfer rollers 55, a secondary transfer device 52, and a fixing unit 53. Further included in the image forming unit 5 are the main sheet conveying path 70, a sheet reversing path 73, and a sheet ejecting path 60 or the like. The intermediate transfer belt 44 circulates clockwise in FIG. 2 as a belt driving roller 45 rotates.

Further, as shown in FIG. 2, the exposing unit 51 is placed adjacent to the tandem image forming unit 50, and exposes each of four component color photoconductors 74 employed corresponding to component colors, respectively. The tandem image forming unit 50 is located above the intermediate transfer belt 44, and includes four image forming units 75 of yellow, cyan, magenta, and black component colors arranged along a direction of rotation of the intermediate transfer belt 44. Each of the image forming units 75 includes an electric charger, a developing device, a photoconductive drum cleaner, and an electric charge remover around the photoconductor 74, and is configured as a process cartridge to integrally support these devices. The process cartridge is removable from the apparatus frame 11.

In the tandem image forming unit 50, multiple toner images of separated colors are formed on the respective photoconductors 74 based on image information read and separated into component colors by the image reading unit 4. The toner images formed on the respective photoconductors 74 are then transferred onto a surface of the intermediate transfer belt 44 by the primary transfer roller 55 to which a transfer voltage is applied. On the other hand, on the opposite side of the tandem image forming unit 50 across the intermediate transfer belt 44, there is provided the secondary transfer device 52. The secondary transfer device 52 includes a secondary transfer roller 521 acting as a transfer member, and forms a secondary transfer nip by pressing the secondary transfer roller 521 against the intermediate transfer belt 44. Hence, in the secondary transfer nip, the toner image transferred onto the intermediate transfer belt 44 is transferred onto a sheet transported from the sheet feeding unit 3.

The sheet with the toner image transferred thereon in the secondary transfer nip is further fed to the fixing unit 53 by a sheet conveying belt 56 suspended around a pair of supporting rollers 57. The fixing unit 53 is constituted by a pressure roller 59 pressing against a fixing belt 58 acting as an endless belt. In the fixing unit 53, toner in the toner image transferred onto the sheet is fused and settled (i.e., fixed) onto the sheet by applying heat and pressure from the pressure roller 59 to the sheet. The sheet with the fixed toner image thereon is then ejected to an outside of the apparatus frame 11 via a sheet ejecting path 60 acting as an ejected sheet conveyance path, and is stacked on a sheet ejecting tray 61 located in the outside of the image forming unit 5 of the copier 1.

Further, as shown in FIG. 2, below the secondary transfer device 52 and the fixing unit 53, there is provided a sheet reversing path 73. To form images on both sides of the sheet, the sheet reversing path 73 turns the sheet ejected from the fixing unit 53 upside down and further guides the sheet again to the secondary transfer device 52 via the main sheet conveying path 70.

Figure 3:
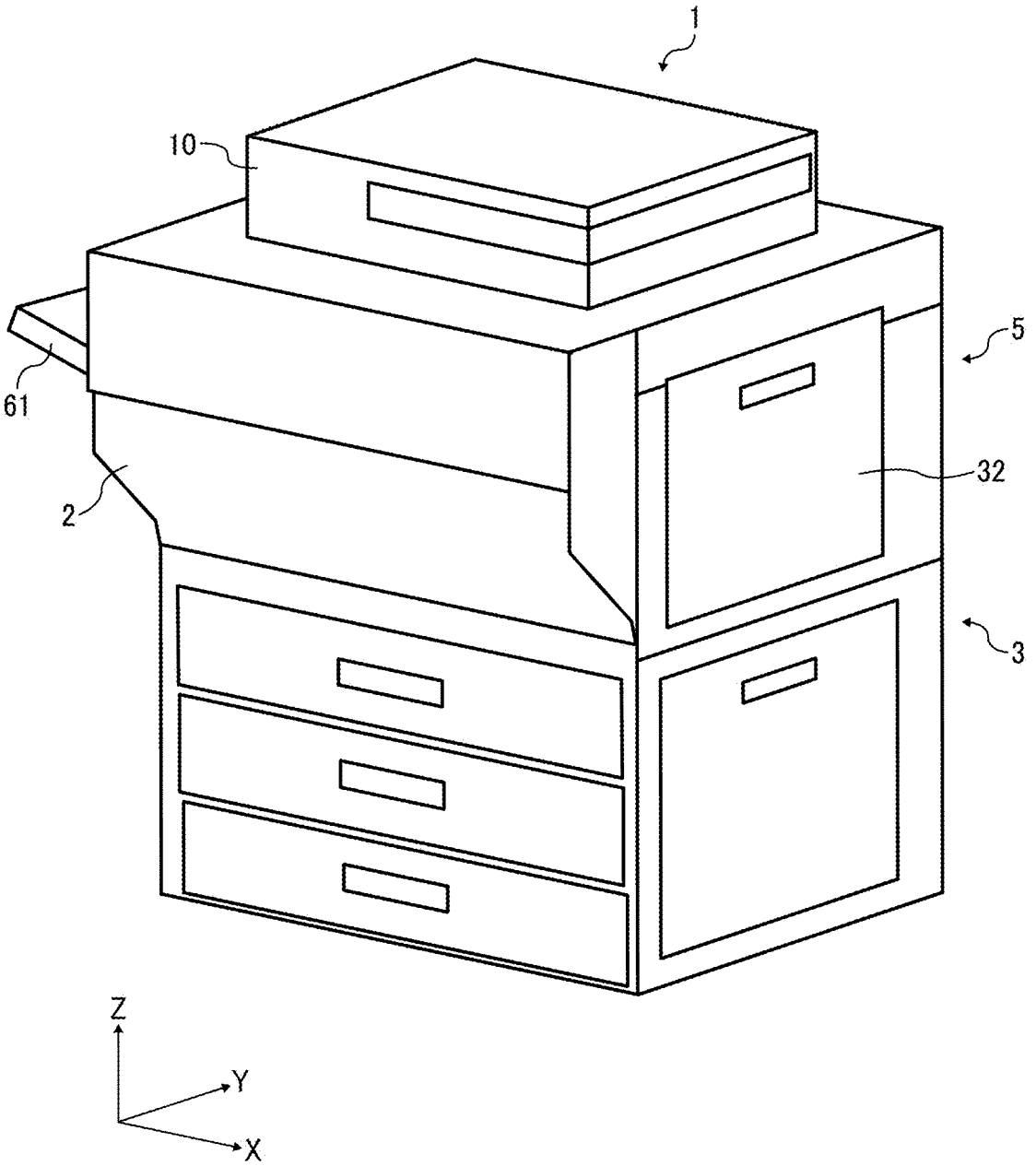
FIG. 3 is a perspective view schematically illustrating the copier of FIG. 3.
Figure 4:
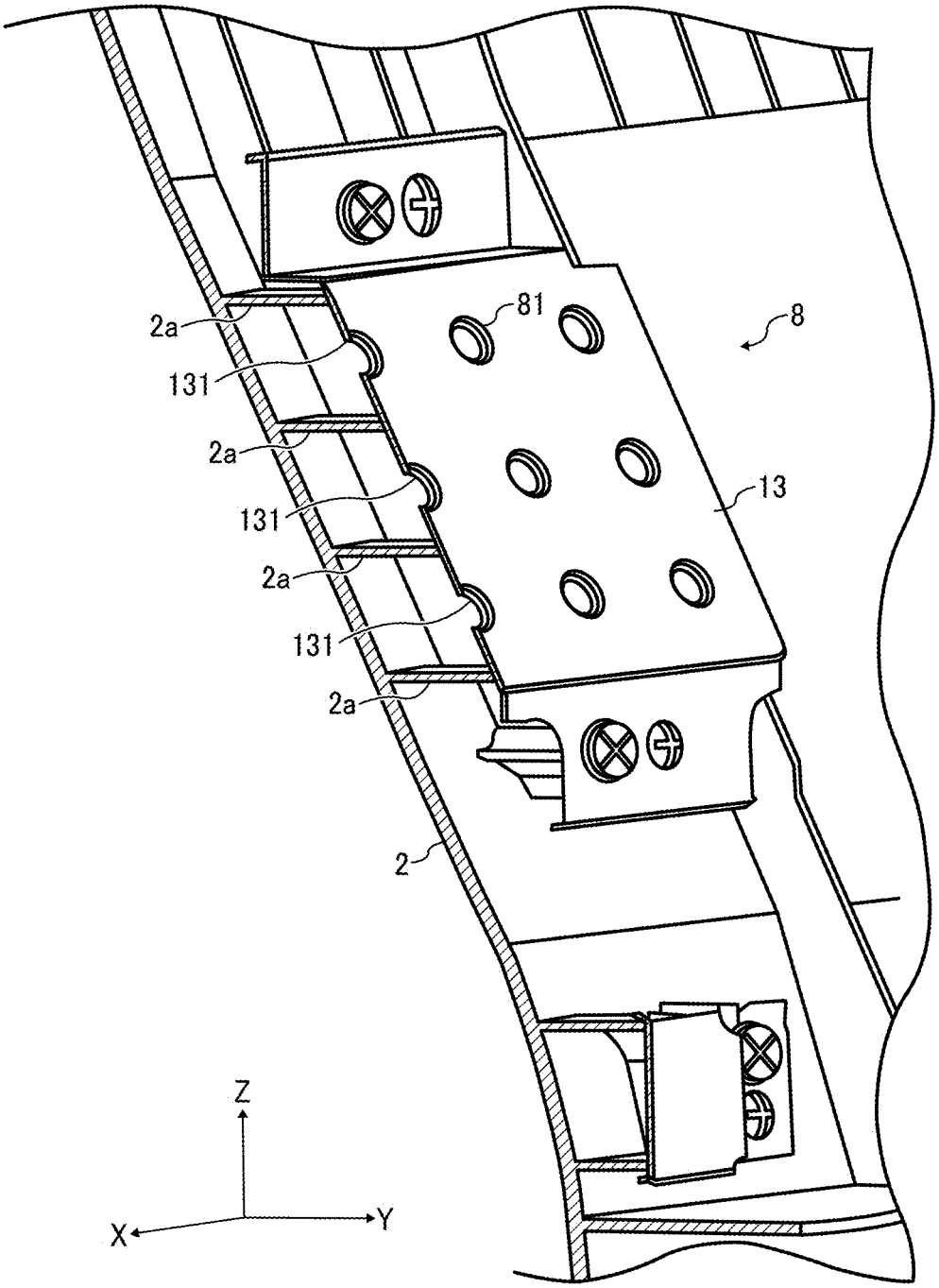
FIG. 4 is a cross-sectional view partially illustrating an exemplary front exterior cover, on which the sound absorber is placed, according to one embodiment of the present disclosure.
Figure 5:
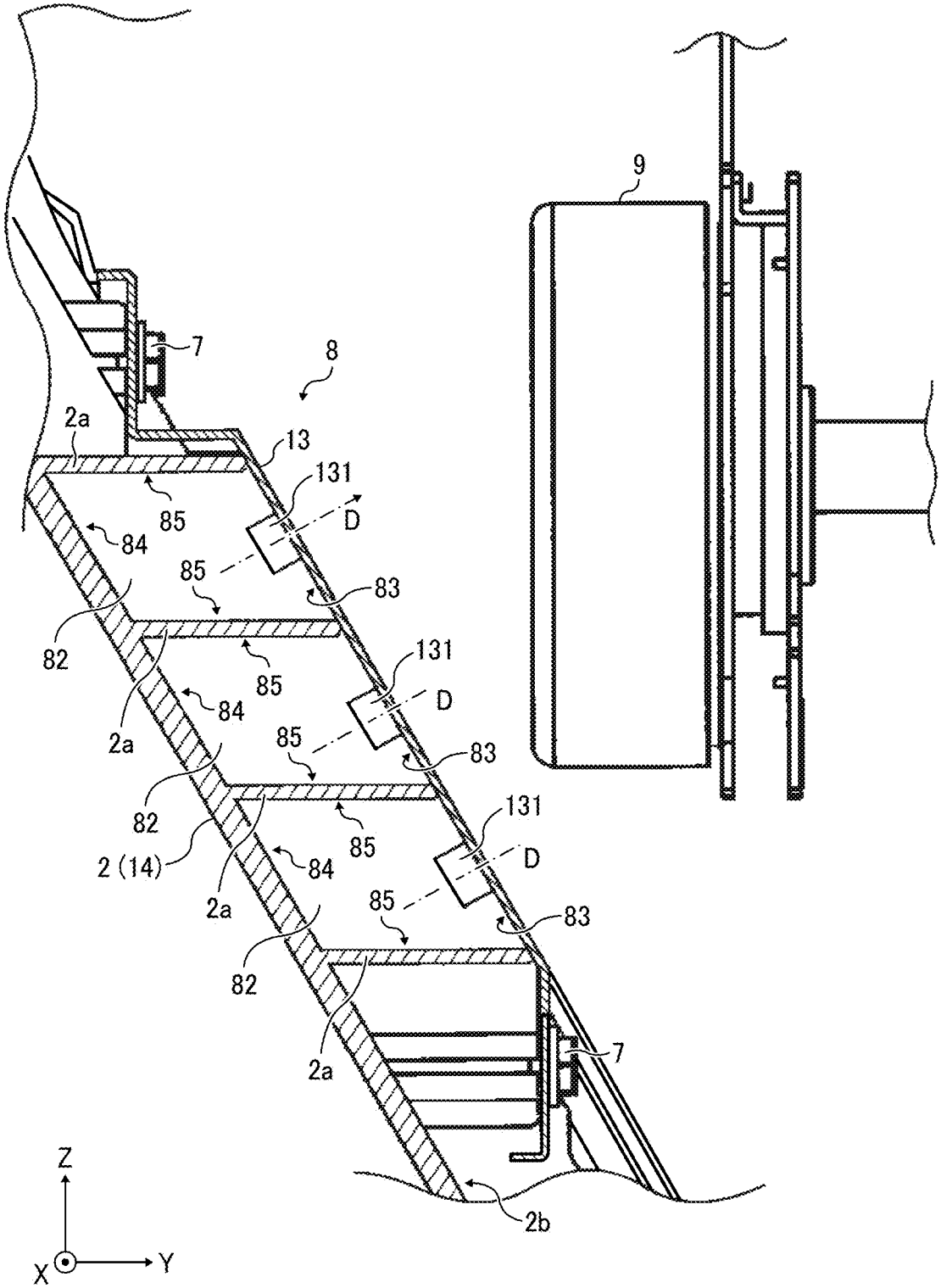
FIG. 5 is a cross-sectional view schematically illustrating the sound absorber shown in FIG. 4 and a drive motor acting as a sound source according to one embodiment of the present disclosure.
Figure 6:
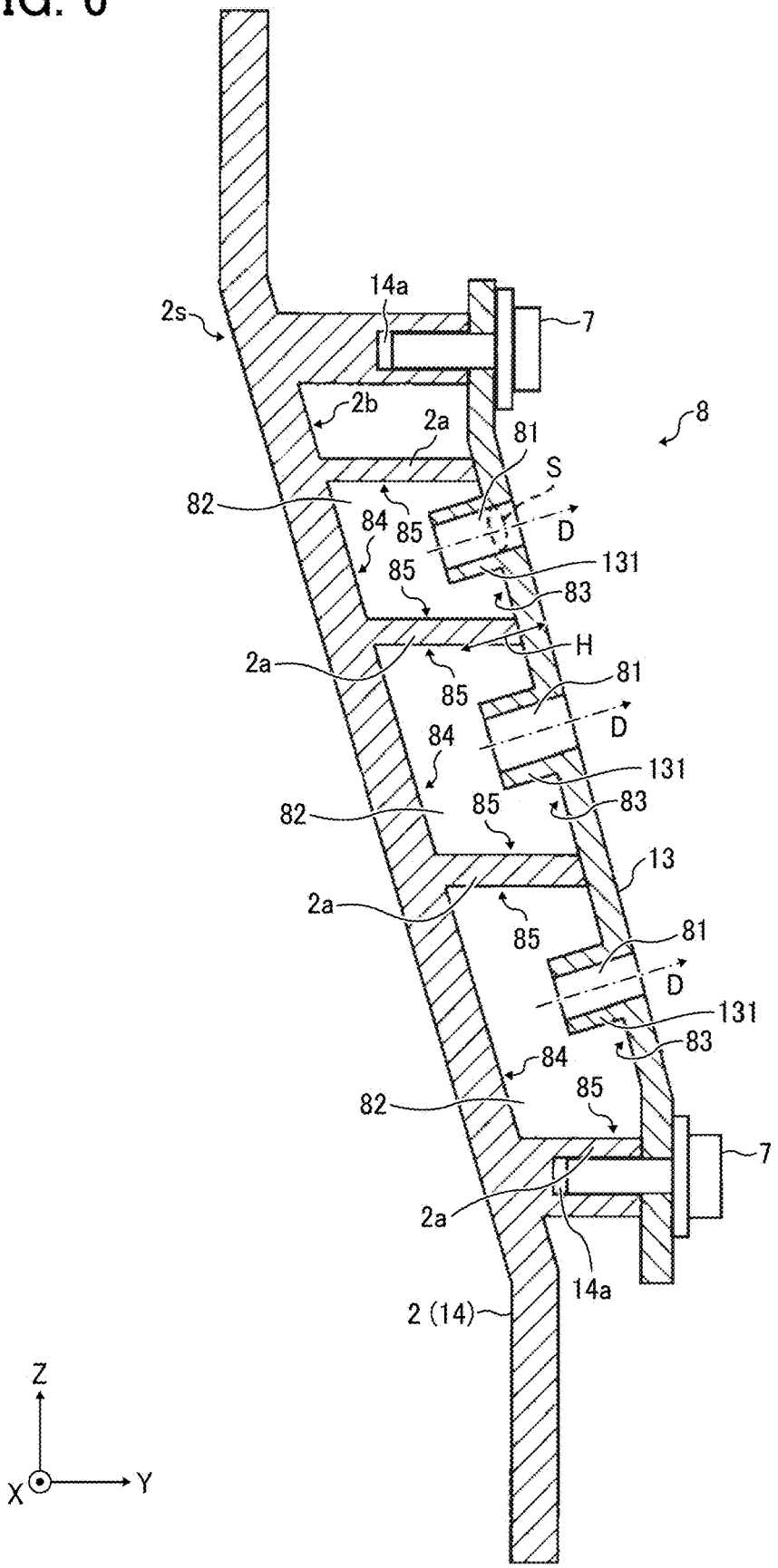
FIG. 6 is a diagram schematically illustrating the sound absorber shown in FIG. 5.

FIG. 3 is a perspective view schematically illustrating an exemplary copier 1. As shown there, an upper part of a front exterior cover 2 disposed at a front side of the image forming unit 5 of the copier 1 projects into the front side of the apparatus frame 11 (i.e., a front side in a direction perpendicular to a plane of FIG. 2). FIG. 4 is a cross-sectional view schematically illustrating the front exterior cover 2 when taken from a slanted deep side of the apparatus frame 11. As shown there, on a rear side of the front exterior cover 2, there is provided a sound absorber 8. FIG. 5 is a cross-sectional view schematically illustrating the sound absorber 8 shown in FIG. 4 when taken from a right side (i.e., a right side in FIG. 2) of the copier 1. FIG. 6 is a diagram schematically illustrating the sound absorber shown in FIG. 5.

As shown in FIGS. 4 to 6, in the inside surface of the front exterior cover 2, there are provided multiple ribs 2*a* that inwardly project from the front exterior cover 2. To almost cover multiple spaces between adjacent multiple ribs 2*a*, a top surface forming member 13 is provided. Hence, the sound absorber 8 with a Helmholtz resonator is constituted. In this embodiment, since the front exterior cover 2 is an injection molding product made of resin and a mold is pulled in a left-right direction in FIG. 6 during a molding process, the ribs 2*a* formed parallel to the direction of removal of the projects from the front side of the apparatus frame 11 (i.e., a left side in FIG. 6) towards a rear side of the apparatus frame 11 (i.e., a right side in FIG. 6). Further, in this embodiment of the present disclosure, since a portion of an exterior surface 2*s* of the front exterior cover 2, in a rear side of which the sound absorber 8 is disposed, inclines to the mold direction of removal (i.e., the left-right direction in FIG. 6), the protruding direction of the rib 2*a* also inclines to a rib forming surface 2*b* located on the rear side of the exterior surface 2*s*.

Now, to further an understanding of the present disclosure, a comparative sound absorber is briefly described hereinafter with reference to FIGS. 18 to 21.

Figure 18:
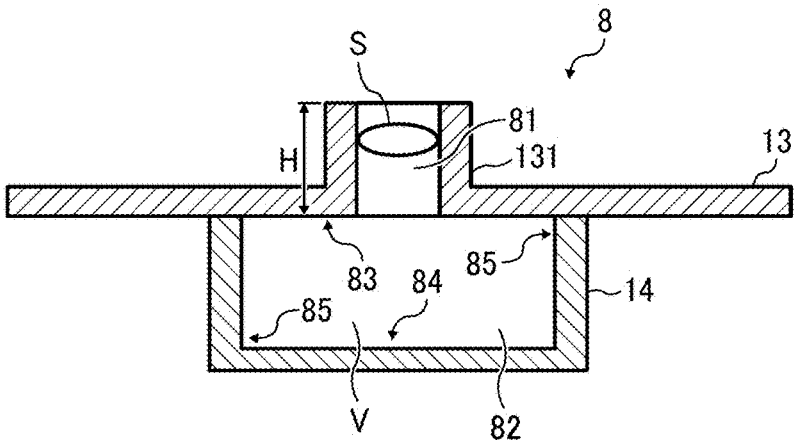
FIG. 18 is a cross-sectional view schematically illustrating a first comparative example of the sound absorber.

FIG. 18 is a cross-sectional view schematically illustrating a first comparative example of a sound absorber 8. As shown there, the comparative sound absorber 8 with the Helmholtz resonator structure has a shape like a vessel having a narrow entrance. That is, the comparative sound absorber 8 is configured by including a cavity 82 having a certain volume and a narrower mouth 81 than the cavity 82 to absorb a sound having a prescribed frequency and coming to the mouth 81.

As shown in FIG. 18, the sound absorber 8 includes a top surface forming member 13 to form a top surface 83, in which the mouth 81 is disposed to communicate the cavity 82 with an outside thereof, as a part of a wall surface that constitutes the cavity 82 of the Helmholtz resonator. The sound absorber 8 further includes a cavity forming member 14 to form the other wall surface of the cavity 82 (e.g., a bottom surface 84 and a side wall surface 85) as well.

The top surface forming member 13 includes a cylindrical flange 131 that projects outward therefrom. Hence, an inside of the flange 131 constitutes the mouth 81 having dimensions of a cross-sectional area S and a length H. Hence, the cavity 82 having a cubic volume V is constituted by fixing the cavity forming member 14 to the top surface forming member 13. When a cubic volume of the cavity 82 of the sound absorber 8 is V, an opening area of the mouth 81 is S, a length of the mouth 81 is H, a sound velocity is c, and a sound absorbing frequency in the sound absorber 8 is f, the following formula is established.

$$f = \frac{c}{2\pi}\sqrt{\frac{S}{V(H+\Delta r)}}$$

In the formula, Δr indicates a mouth end correction member, and is 0.6r (i.e., Δr=0.6r) in general when a cross section of the mouth 81 is round and a radius of the cross section is r. As shown in the formula above, frequency of sound absorbed by the sound absorber 8 can be obtained based on the cubic volume V of the cavity 82, the length H of the mouth 81, and an opening area S of the mouth 81.

As shown in FIG. 18, in the cavity 82 of the sound absorber 8 of the comparative example, the top surface 83 and the bottom surface 84 are parallel to each other. The side wall surface 85 is either cylindrical or a polygonal cylinder state and is perpendicular to each of the top surface 83 and the bottom surface 84.

Now, a problem raised when the sound absorber 8 shown in FIG. 18 is disposed in a member, such as the front exterior cover 2, etc., shown in FIG. 6, in which a sticking out direction of the rib 2*a* inclines to the rib forming surface 2*b*, is discussed herein below.

That is, an injection molding resin product, such as the front exterior cover 2, etc., is generally molded by pouring resin or the like into a mold. However, it is most inexpensive and accurate if the mold is moved only in one direction. When the Helmholtz resonator, which needs the cavity 82 and the mouth 81, is constituted by using the injection molding product, the Helmholtz resonator is hardly constituted by a single member. However, a part of the wall surface of the cavity 82 can be readily formed by using the injection molding product. Hence, the Helmholtz resonator of the sound absorber 8 shown in FIG. 18 is structured by combining multiple members (13 and 14). In addition, in terms of cost and space, the injection molding product partially producing the Helmholtz resonator is frequently molded by including the other feature as well beside a part of the Helmholtz resonator.

The front exterior cover 2 shown in FIG. 6 functions as a cavity forming member 14, because the rib forming surface 2*b* thereof acts as a bottom surface 84 of the cavity 82 and a side surface of the rib 2*a* acts as a side wall surface 85 of the cavity 82. Hence, as also shown in FIG. 6, by combining the front exterior cover 2 with the top surface forming member 13, the Helmholtz resonator is constituted. In addition, the front exterior cover 2 that constitutes the cavity forming member 14 of the Helmholtz resonator as the injection molding product is molded to also function as the exterior cover of the copier 1.

Figure 19:
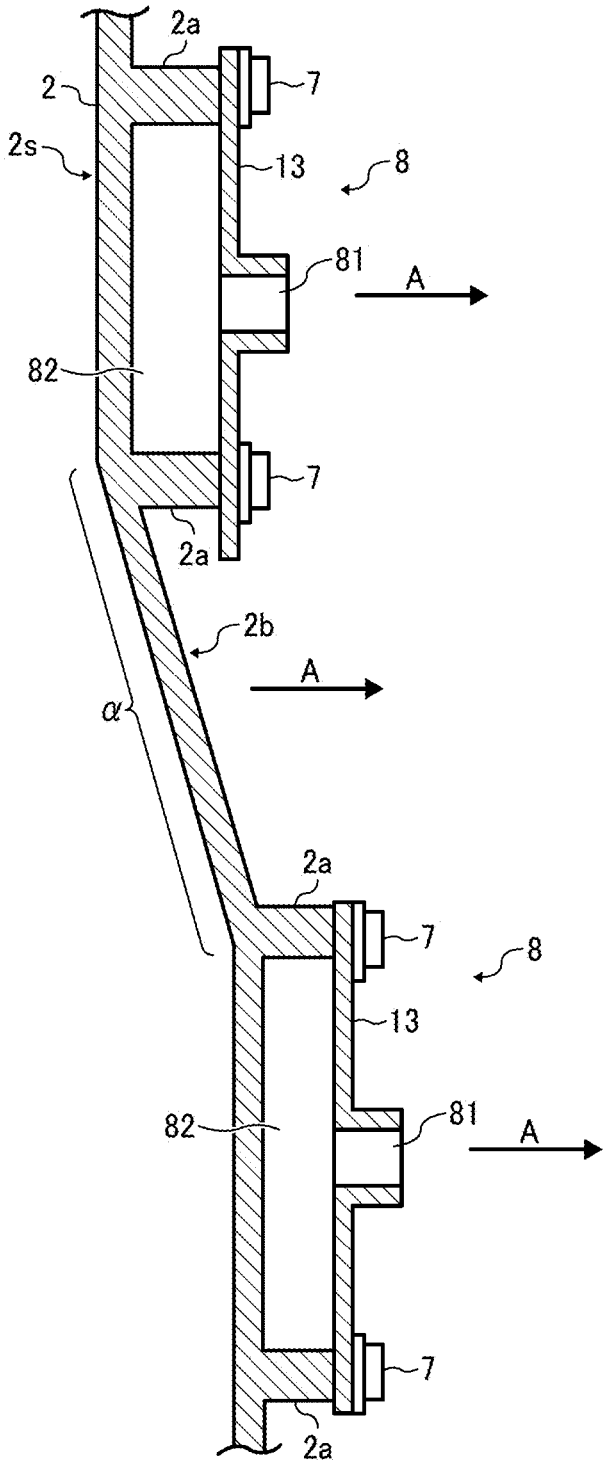
FIG. 19 is also a cross-sectional view schematically illustrating a second comparative example of the sound absorber.

However, when a part of a structure of the Helmholtz resonator and the other functional part are included at the same time in one injection molding product, the sound absorber 8 of the comparative example shown in FIG. 18 cannot be disposed sometimes, for the reasons described below FIG. 19 is also a cross-sectional view schematically illustrating a second comparative example, in which the sound absorber 8 of the first comparative example of FIG. 18 is disposed in the front exterior cover 2 shown in FIG. 6. In the drawing of FIG. 19, arrow A indicates a direction of extraction of a mold that faces the rib forming surface 2*b* when the front exterior cover 2 is molded by an injection molding process with the mold. As shown there, since the rib 2*a* is formed in the direction, in which the mold is removed as shown by arrow A, the rib forming surface 2*b* inclines to a surface of the rib 2*a* in a portion of the front exterior cover 2 indicated by a reference character a in FIG. 19. For this reason, a sound absorber 8 including a cavity 82 constituted by a rib forming surface 2*b* as a bottom surface 84 and a side wall surface 85 formed perpendicular to the bottom surface 84 cannot be placed in the range indicated by the reference character a.

Figure 20:
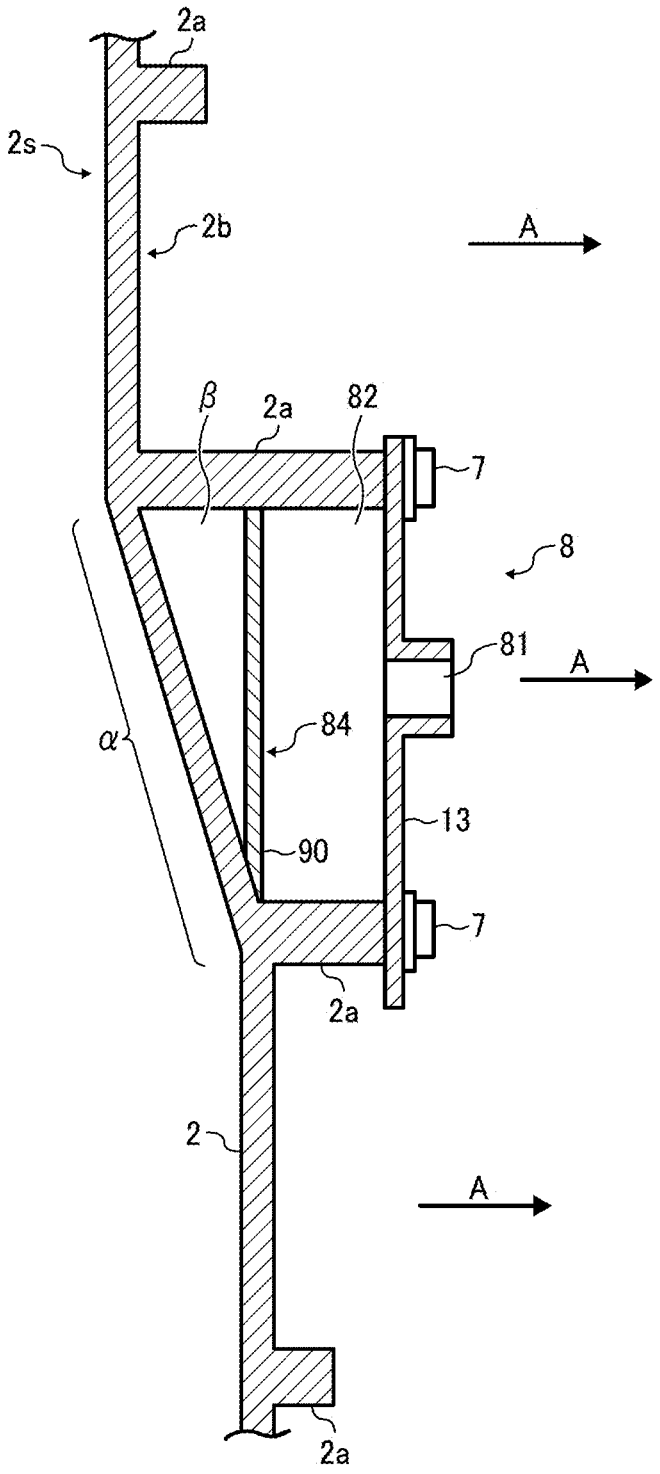
FIG. 20 is also a cross-sectional view schematically illustrating a third comparative example of the sound absorber.

FIG. 20 is also a cross-sectional view schematically illustrating a third comparative example, in which the sound absorber 8 of the first comparative example shown in FIG. 18 is disposed in the front exterior cover 2 shown in FIG. 6. That is, as shown in the drawing of FIG. 20, a bottom plate 90 serving as a bottom surface 84 formed perpend to the surface of the ribs 2*a* is disposed on the surface of the ribs 2*a* to dispose a sound absorber 8 as a comparative example in the portion of the front exterior cover 2 as shown by a reference character a, in which the rib forming surface 2*b* inclines to the surface of the rib 2*a*. However, in the third comparative example, although the sound absorber 8 is placed in the range indicated by the reference character a, a separate member, such as the bottom plate 90, etc., is additionally needed. In addition, a dead space is accordingly formed between the bottom plate 90 and the rib forming surface 2*b* as indicated by a reference character p.

Figure 21:
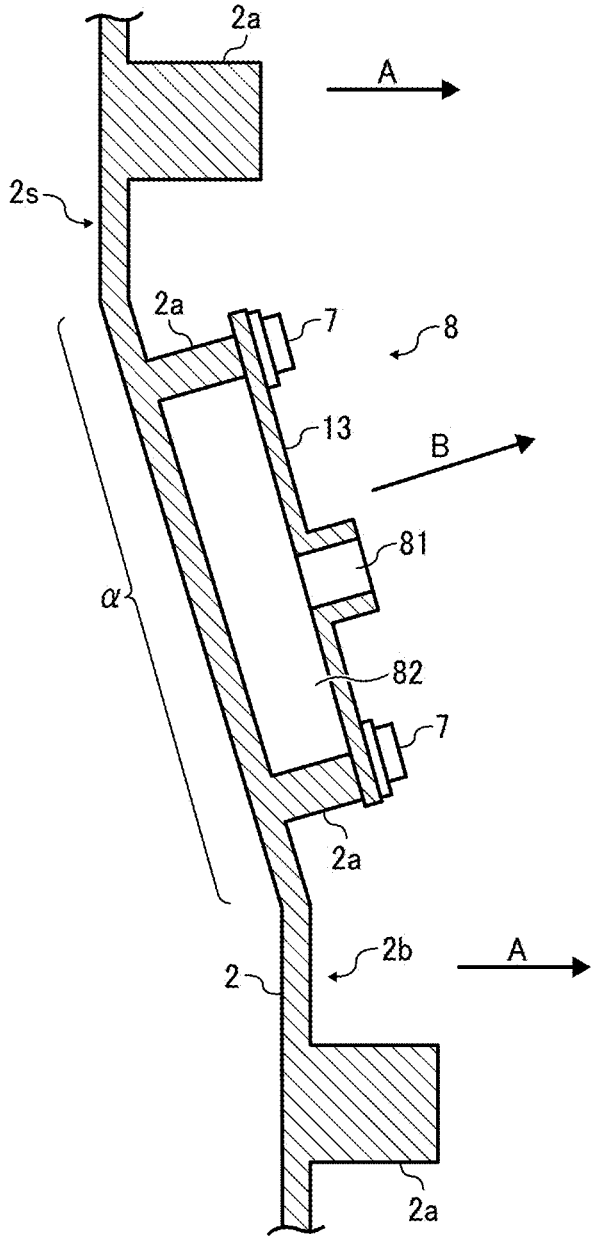
FIG. 21 is a cross-sectional view schematically illustrating a fourth comparative example of the sound absorber.

FIG. 21 is a cross-sectional view schematically illustrating a fourth comparative example, in which the sound absorber 8 of the comparative example shown in FIG. 18 is disposed in such a manner that one or more ribs 2*a* are formed in the portion of the front exterior cover 2 corresponding to the range as indicated by the reference character a and project perpendicular to the rib forming surface 2*b*. As can be understood from FIG. 21, to mold the front exterior cover 2 having the shape shown in FIG. 21, in addition to the mold that moves in the direction A in FIG. 21, another sliding mold that moves in a direction as shown by arrow B in FIG. 21 is separately needed at the same time as well. Consequently, usage of the sliding mold may cause a problem of increasing manufacturing costs while degrading accuracy of parts as well.

By contrast, however, in the sound absorber 8 according to various embodiments and modifications of the present disclosure, the top surface 83 and the bottom surface 84 are inclined with respect to the side wall surface 85 of the cavity 82. That is, in the sound absorber 8 of the various embodiments and modifications of the present disclosure, since a surface of the rib 2*a* extended in a direction, in which the mold of the front exterior cover 2 of FIG. 6 is removed, constitutes the side wall surface 85, and the bottom surface 84 and the top surface 83 of the cavity 82 are inclined with respect to the surface of the rib 2*a* (i.e., the side wall surface 85), the Helmholtz resonator can be structured without sliding the mold.

Now, a first practical example of one embodiment of the present disclosure is described with reference back to FIG. 1 and applicable drawings.

Figure 1:
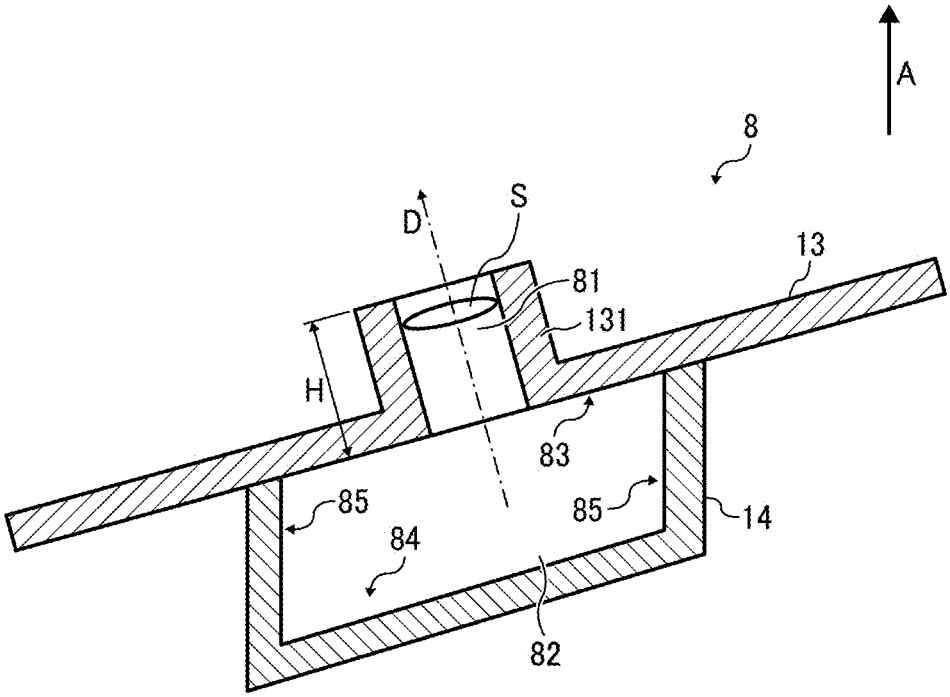
FIG. 1 is a cross-sectional view schematically illustrating an exemplary sound absorber according to one embodiment of the present disclosure.

FIG. 1 is a cross-sectional view schematically illustrating a sound absorber 8 according to the first embodiment of the present disclosure. As shown in the drawing of FIG. 1, the sound absorber 8 includes a top surface forming member 13, in which a mouth 81 is formed, and a cavity forming member 14. That is, by connecting the top surface forming member 13 with the cavity forming member 14, a cavity 82 is constituted. Specifically, the cavity 82 is constituted by a top surface 83 as a part of a surface of the top surface forming member 13, in which a mouth 81 is formed, a bottom surface 84 opposed to the top surface 83, and a side wall surface 85 that extends to connect the top surface 83 with the bottom surface 84. In the sound absorber 8 of the first embodiment of the present disclosure, both of the top surface 83 and the bottom surface 84 are inclined with respect to the side wall surface 85.

In the sound absorber 8 of the first embodiment of the present disclosure, a direction shown by arrow A in FIG. 1 corresponds to a direction of pulling the mold when the cavity forming member 14 made of resin is molded by using the injection molding process.

Since the cavity forming member 14 of the first embodiment of the present disclosure is made of resin, density thereof is less than that of material of the top surface forming member 13 made of metal and is easy to process. A flange 131 is formed in the top surface forming member 13 by using a burring process. Hence, an inner side of the flange 131 defines a cross-sectional area S and a length H of the mouth 81. The top surface forming member 13 and the cavity forming member 14 are tightly connected to each other by using either a screw or an insert molding process and the like. Hence, the cavity 82 having the cubic volume V is constituted by fixing the top surface forming member 13 to the cavity forming member 14.

The burring process is performed by making a pre-hole in a plate, pressing a punch hole having a larger diameter than that of the pre-hole against the pre-hole while spreading out an edge of the pre-hole, thereby forming the flange around the mouth 81. Hence, by producing the mouth 81 by using the burring process, a separate member that constitutes the mouth 81 is not additionally employed in the top surface forming member 13 that partially constitutes the wall surface of the cavity 82. That is, the top surface forming member 13 can be formed including the mouth 81.

Since sound not entering the mouth 81 enters an outer wall surface located around the mouth 81, among the entire wall surface that forms the cavity 82, a portion of the wall surface, in which the mouth 81 is formed, is desirably made of metal (e.g., a sheet metal) having excellent performance of either suppressing or reducing transmitting sound. When the sound enters the wall, transmission loss of the sound increases (i.e., sound transmission is increasingly difficult) as density of the wall increases. When material of the wall is homogeneous, the thicker the wall, the greater the sound absorption. Similarly, when material of the wall is homogeneous, the greater the density of the material of the wall (i.e., mass per unit cubic volume), the greater the sound absorption again. Because of this, the top surface forming member 13 that forms (or provides) the top surface 83 among the entire wall surface that forms the cavity 82, in which the mouth 81 is formed, is made of sheet metal having greater density than resin. Hence, transmission of the sound can be reduced. In addition, when the sheet metal is used, sound hitting a side of the sheet metal facing a sound source hardly permeates the sheet metal and is largely reflected therefrom. Hence, an amount of sound reflected and directed to the mouth 81 relatively increases, thereby improving sound absorbing performance.

The sound absorber 8 is preferably disposed with a mouth of the mouth 81 directed toward the source of sound to be absorbed as shown by a broken line arrow D in FIG. 1. The opening direction of the mouth 81 is defined by a virtual linear line extended over a gravity center of a horizontal cross section of one end of the mouth 81 on the side of the cavity 82 and a gravity center of a horizontal cross section of an external end of the mouth 81. Hence, when the mouth 81 is cylindrical, the opening direction of the mouth 81 is equivalent to a central line of a cylinder of the mouth 81. Hence, by directing the mouth 81 toward the sound source, sound to be absorbed easily enters the mouth 81 and accordingly, absorbing performance can be effectively improved.

A flange 131 is formed as a standing section to almost project from the plate-like portion of the top surface forming member 13 in the communication direction through which the cavity 82 is communicated with the outside. The flange 131 of the sound absorber 8 of FIG. 1 projects outwardly from the cavity 82 as shown in FIG. 1. Further, the greater the difference between a diameter of the pre-hole and a diameter of the punch hole, the taller the flange 131. Accordingly, a length H of an inner portion of the mouth 81 increases in proportion to the difference. Because of this, by adjusting the difference between the diameter of the pre-hole and the diameter of the punch hole, both of the height of the flange 131 and the length H of the mouth 81 can be adjusted at the same time.

Now, an exemplary sound absorbing system according to one embodiment of the present disclosure is herein below described with reference to FIGS. 4 to 6. That is, in the exemplary sound absorbing system of this embodiment, a sound absorber 8 is constructed by using a front exterior cover 2 as a cavity forming member 14. Both of a top surface 83 and a bottom surface 84 are inclined with respect toward a side wall surface 85 as in the first embodiment of the present disclosure. A flange 131 is formed to inwardly project from a cavity 82. Hence, the sound absorber 8 is disposed in the front exterior cover 2 as shown in FIGS. 4 to 6. With this, a unique configuration can be obtained as shown in the drawings of FIGS. 4 to 6. That is, since the flange 131 inwardly projects toward the cavity 82, the mouth 81 can be elongated sufficiently to set a sound absorbing frequency to a low level even if an outer space of the cavity 82 is narrow and unable to externally accommodate the sufficient length of the mouth 81. At the same time, projections that externally project from the cavity 82 can be omitted, and accordingly the flange 131 does not disturb an operator during his or her assembly and maintenance as well.

Further, in the sound absorber 8 of the first embodiment of the present disclosure of FIG. 1, since the flange 131 projects perpendicular to the top surface 83, the communication direction is also perpendicular to the top surface 83 as well. Similarly, in the sound absorber 8 of FIGS. 5 and 6, the communication direction is again perpendicular to the top surface 83 as well. Since the top surface 83 is inclined, the communication direction is obliquely upward and is inclined with respect to the side wall surface 85 formed by a horizontally projecting rib 2*a*. In addition, as shown in FIG. 5, a drive motor 9 acting as a sound source is located in the communication direction of the sound absorber 8.

That is, since the sound absorber 8 of the first embodiment of the present disclosure is disposed in a inclined portion of a rib forming surface 2*b* of the front exterior cover 2, the sound absorber 8 can be located yet near the drive motor 9 with the communication direction facing the drive motor 9 without colliding with the drive motor 9. In general, when a distance from the sound source to the sound absorber 8 using the Helmholtz resonator is short, since the sound absorber 8 can effectively absorb the sound before the sound propagates globally, sound absorbing performance of the sound absorber 8 located near the drive motor 9 can be improved. Hence, according to the configuration of this embodiment of the present disclosure shown in FIG. 5, the sound, such as a drive sound, etc., generated by the drive motor 9 can be effectively absorbed.

Now, the above-described embodiment of the present disclosure shown in FIG. 5 is more specifically described with reference to FIG. 21. As shown there, in the sound absorber 8, the cavity forming member 14 is made of resin and the top surface forming member 13 is made of metal. The cavity forming member 14 and the top surface forming member 13 are fixed to each other by using multiple fastening screws 7. Since these two members are made of material having different density and rigidity from each other and are fixed to each other by the fastening screws 7, the cavity forming member 14 having a lower rigidity deforms along the surface of the top surface forming member 13 having a higher rigidity at a contact section between these two members. As a result, sealability of the cavity 82 can be effectively ensured.

In addition, in the sound absorber 8 of FIG. 6, multiple prepared screw holes 14*a*, with which the fastening screws 7 engage, are formed in a direction, in which the rib 2*a* projects. That is, since a shaft extending direction of each of the fastening screws 7 screwed into the screw holes 14*a*, respectively, is equivalent to the direction of pulling the mold, the prepared screw holes 14*a* can be formed (i.e., molded) during an injection molding process with the mold. FIG. 7 is a diagram again schematically illustrating the sound absorber 8 of FIG. 6 when taken from a right side of the sound absorber in the drawing of FIG. 6. FIG. 8 is a cross-sectional view schematically illustrating the sound absorber 8 of FIG. 7 along a line F-F in FIG. 7. Back to FIG. 6, it is also a cross-sectional view taken along a line E-E in FIG. 7.

Figure 7:
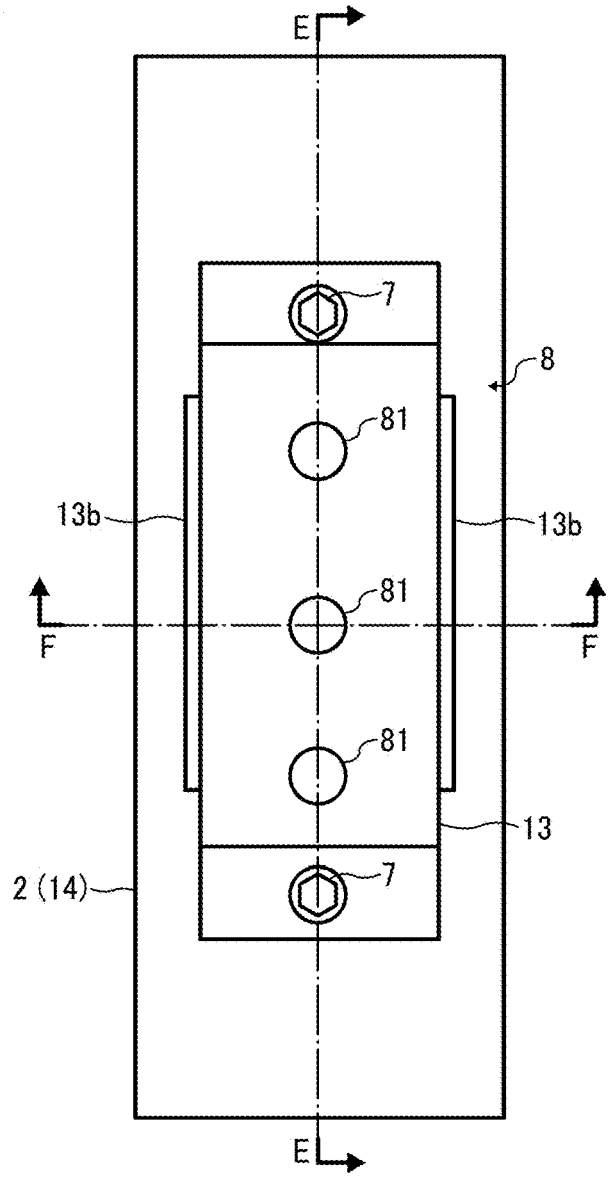
FIG. 7 is a diagram schematically illustrating the sound absorber shown in FIG. 6 when taken from a right side of the sound absorber in FIG. 6.
Figure 8:
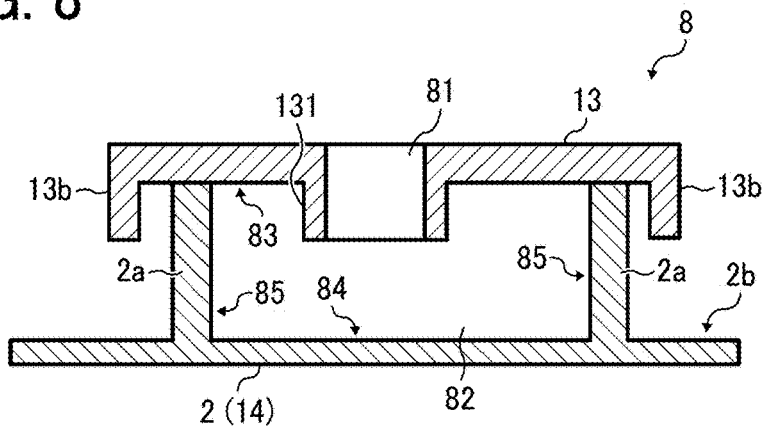
FIG. 8 is a cross-sectional view schematically illustrating the sound absorber of FIG. 7 along line F-F in FIG. 7.

As shown in FIGS. 7 and 8, in the sound absorber 8 of FIG. 6, the top surface forming member 13 made of sheet metal includes a pair of bent portions 13*b* at both side ends thereof in a short side direction (i.e., in left-right directions in FIGS. 7 and 8). As also shown only in FIG. 7, the bent portions 13*b* extend in a lengthwise direction of the top surface forming member 13 to make the top surface forming member 13 to hardly deflect. With this, rigidity of the top surface forming member 13 made of sheet metal is upgraded. In addition, deformation of the top surface forming member 13, which is possibly caused when fastened to the cavity forming member 14 by the fastening screws 7, can be prevented. With this, the sealability of the cavity 82 produced by using the fastening screws 7 can be ensured effectively.

The copier 1 generally generates not only a drive sound of the drive motor 9, but also various operation sounds, such as a movement sound of a moving member (e.g., a roller), a rotational sound of a polygon mirror included in the exposing unit 51, etc. Such an operation sound is transmitted to the outside of the copier 1 and grows to a noise that can offend people working around the copier 1. However, by constituting the sound absorber 8 to match and cancel out a frequency of an operation sound desirably to be suppressed to travel to the outside among the operation sounds which possibly become noises, the operation sound with the frequency can be effectively absorbed and transmission of the noise to the outside can be restricted by the sound absorber 8.

Now, a second embodiment of the present disclosure is described with reference to FIG. 9.

Figure 9:
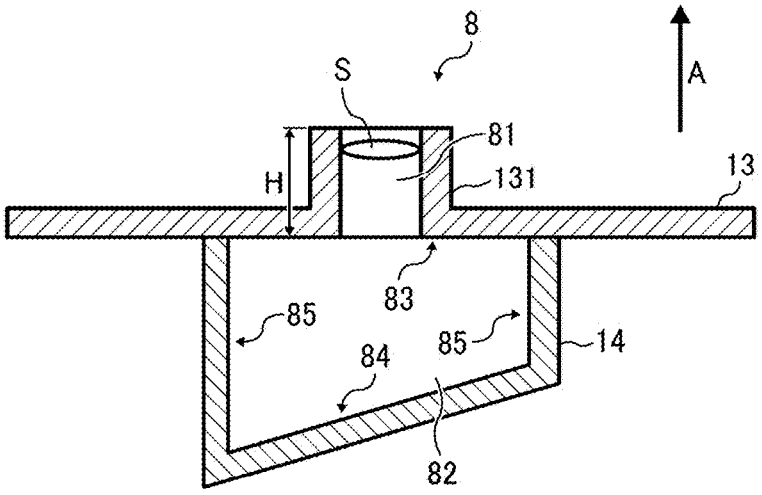
FIG. 9 is a cross-sectional view schematically illustrating a sound absorber according to a second embodiment of the present disclosure.

That is, FIG. 9 is a cross-sectional view schematically illustrating the sound absorber 8 according to the second embodiment of the present disclosure. In the sound absorber 8 of the first embodiment of the present disclosure, both of the top surface 83 and the bottom surface 84 are inclined with respect to the side wall surface 85. By contrast, as shown in FIG. 9, in a sound absorber 8 of the second embodiment of the present disclosure, only a bottom surface 84 is inclined with respect to the side wall surface 85 as only a difference from the first embodiment of the present disclosure. That is, the other configuration is substantially the same as the first embodiment of the present disclosure. Similar to FIG. 1, an arrow A shown in FIG. 9 represents a direction, in which a mold is removed during an injection molding process to mold a cavity forming member 14 made of resin again.

Figure 10:
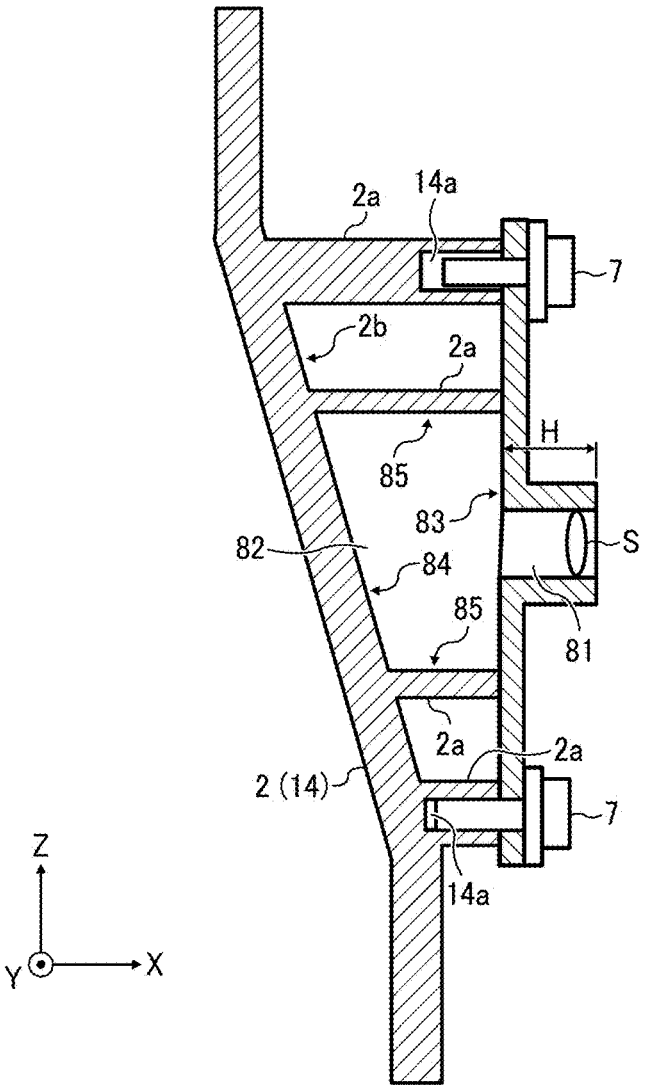
FIG. 10 is a cross-sectional view schematically illustrating the sound absorber mounted on the front exterior cover according to the second embodiment of the present disclosure.

FIG. 10 is a cross-sectional view schematically illustrating a configuration in which the sound absorber 8 of the second embodiment of the present disclosure is employed in the front exterior cover 2 shown in FIG. 6. As shown there, even if the sound absorber 8 has the above-described construction of the second embodiment of the present disclosure, the sound absorber 8 can be disposed in the inclined part of the front exterior cover 2, in which the rib forming surface 2*b* is located, without generating a dead space.

In addition, as shown in FIG. 9, the top surface 83 is inclined with respect to the bottom surface 84 in the sound absorber 8 of the second embodiment of the present disclosure. Because of this, a freedom of layout of the sound absorber 8 of this second embodiment of the present disclosure is greater than the sound absorber 8, in which the top surface 83 and the bottom surface 84 are parallel to each other, and accordingly, a cavity 82 of the sound absorber 8 of this embodiment of the present disclosure can be sometimes widener even when the same configuration space is used.

Now, a first modification of the second embodiment of the present disclosure is herein below described with reference to FIG. 11 and applicable drawings.

Figure 11:
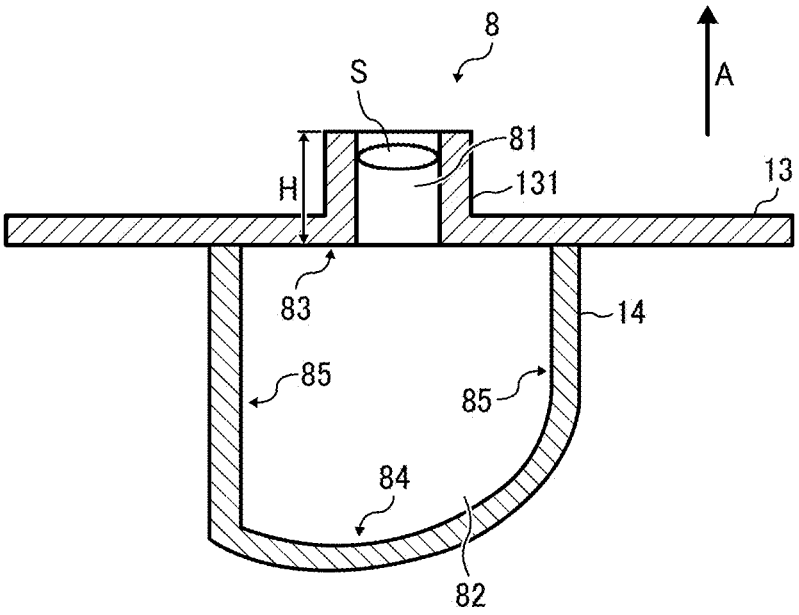
FIG. 11 is a cross-sectional view schematically illustrating a first modification of the sound absorber of the second embodiment of the present disclosure.

That is, FIG. 11 is a cross-sectional view schematically illustrating an exemplary sound absorber 8 of the first modification of the second embodiment of the present disclosure. That is, in the second embodiment of the present disclosure, the bottom surface 84 inclined with respect to the side wall surface 85 is planar having a rectangular cross section. However, a cross section of the bottom surface 84 inclined with respect to the side wall surface 85 may be curved in this modification as shown in FIG. 11. Similar to the sound absorber 8 shown in FIG. 1, an arrow A shown in FIG. 11 represents a direction, in which a mold is removed during an injection molding process to mold a cavity forming member 14 made of resin again.

Although the copier 1 of this embodiment of the present disclosure employs a flat and sloping front exterior cover 2 as shown in FIG. 3, the copier 1 can employs a curved front exterior cover 2 as well. In such a situation, the sound absorber 8 of the first modified example of the present disclosure can be employed.

Further, although the top surface forming member 13 is made of metal and the cavity forming member 14 is made of resin in the above-described first and second embodiments and the first modification of the second embodiment of the present disclosure, the top surface forming member 13 may be made of resin and the cavity forming member 14 may be made of metal as well. In such a situation, by preparing a cavity forming member 14 by using a metal component, such as the body frame of the copier 1, etc., and attaching the resin top surface forming member 13 to the cavity forming member 14, a sound absorber 8 with both of a top surface 83 and a bottom surface 84 inclined with respect to a side wall surface 85 of the cavity 82 may be constructed.

Now, a second modification of the second embodiment of the present disclosure is herein below described with reference to FIG. 12 and applicable drawings.

Figure 12:
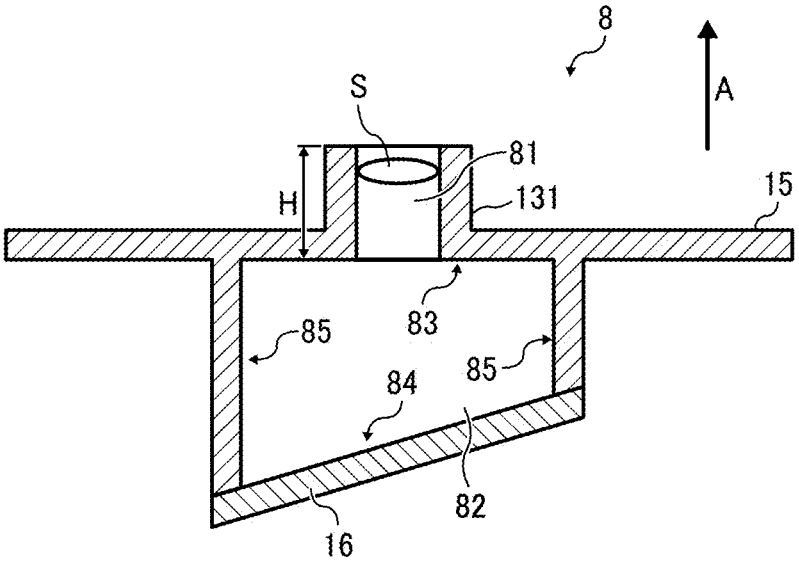
FIG. 12 is a cross-sectional view schematically illustrating a second modification of the sound absorber of the second embodiment of the present disclosure.

FIG. 12 is a cross-sectional view schematically illustrating an exemplary sound absorber 8 of a second modification of the second embodiment of the present disclosure. That is, each of the above-described first and second embodiments and the first modification of the second embodiment of the present disclosure is configured by including two separate members to form the sound absorber 8. That is, a first separate member is the top surface forming member 13 to provide the top surface 83, and a second separate member is the cavity forming member 14 to provide the inner wall surface other than the top surface 83, thereby collectively forming the cavity 82. Similarly, the second modification of the second embodiment of the present disclosure is configured by including two separate members as well to form the sound absorber 8. However, the first separate member is the bottom surface forming member 16 to provide the bottom surface 84, and the second separate member is a top surface and side wall surface forming member 15 to provide the inner wall surface other than the bottom surface 84.

In the sound absorber 8 of the second modification of the second embodiment of the present disclosure shown in FIG. 12, although the top surface and side wall surface forming member 15 is made of resin and the bottom surface forming member 16 is made of metal, the top surface and side wall surface forming member 15 may be made of metal and the bottom surface forming member 16 may be made of resin by contrast as well. Again, in the second modification of the second embodiment of the present disclosure of FIG. 12, a direction shown by arrow A in the drawing if FIG. 12 corresponds to a direction of removing a mold when the top surface and side wall surface forming member 15 made of resin is molded during an injection molding process.

To constitute the sound absorber 8 including the Helmholtz resonator, it is not desirable to additionally employ the top surface forming member 13 and the cavity forming member 14, because the employment of these members leads to increase in cost and weight. By contrast, when the front exterior cover 2 is partially used as the cavity forming member 14, since the cavity forming member 14 does not need to be separately (additionally) employed from the front exterior cover 2, the copier 1 can save space while decreasing its weight and the number of parts and cost at the same time as well.

Now, various front covers to open and close an apparatus frame 11 of the copier 1, to which the present disclosure is applied, are herein below described with reference to FIGS. 13 to 18.

Figure 13:
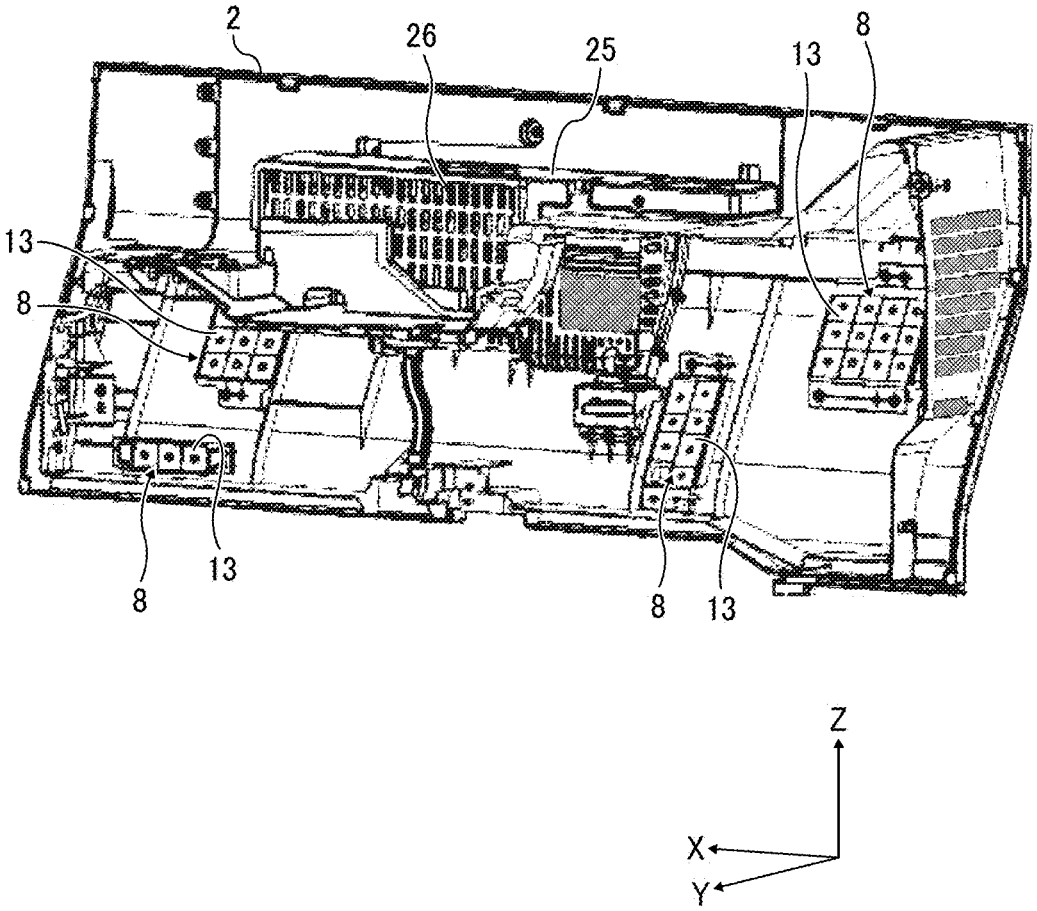
FIG. 13 is a perspective view schematically illustrating the front exterior cover taken from a back side of the front exterior cover according to one embodiment of the present disclosure.

FIG. 13 is a perspective view schematically illustrating the front exterior cover 2 taken from a back side of the front exterior cover 2. As shown there, multiple opening surface forming members 13 are placed at more than one point in the back side of the front exterior cover 2, respectively. Hence, several sound absorbers 8 are formed by using spaces between the front exterior cover 2 and the multiple opening surface forming members 13 as cavities 82 of the Helmholtz resonators, respectively. In this way, the front exterior cover 2 is configured as a double layered structure composed of two overlaid planar members (i.e., the front exterior cover 2 and the top surface forming member 13), so that the spaces between these two planar members are utilized as cavities of the Helmholtz resonators. However, the front exterior cover 2 is not limited to the double layered structure, and can be a multiple layered structure more than a triple layered structure. Further, the front exterior cover 2 is not limited to a type that partially includes the multiple layered structure, and can be a type that entirely employs the multiple structure.

In each of the above-described embodiment and modifications, the front exterior cover 2 exposes interior members installed in the apparatus frame 11 when it is moved (i.e., opened) from the apparatus frame 11 in a closed state as shown in FIG. 2. Specifically, in this embodiment and the modifications of the present disclosure, the front exterior cover 2 is fixed to a drawing unit horizontally drawable to a front side. Hence, the front exterior cover 2 exposes the internal members held on the drawing unit when it is drawn out of the apparatus frame 11 to the front side of the apparatus frame 11.

Figure 14:
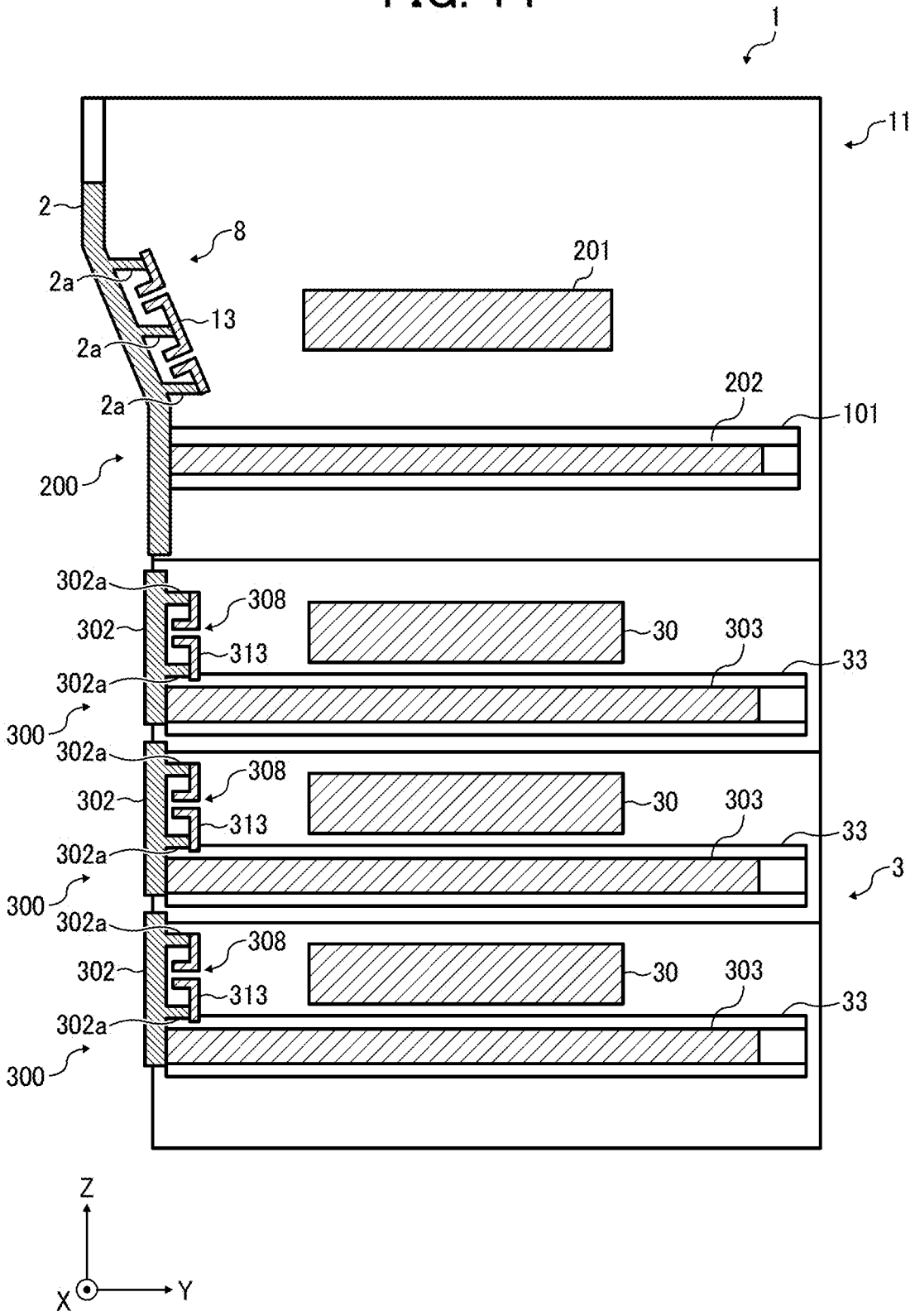
FIG. 14 is a diagram illustrating an exemplary copier, to which multiple drawers are attached, according to one embodiment of the present disclosure.
Figure 15:
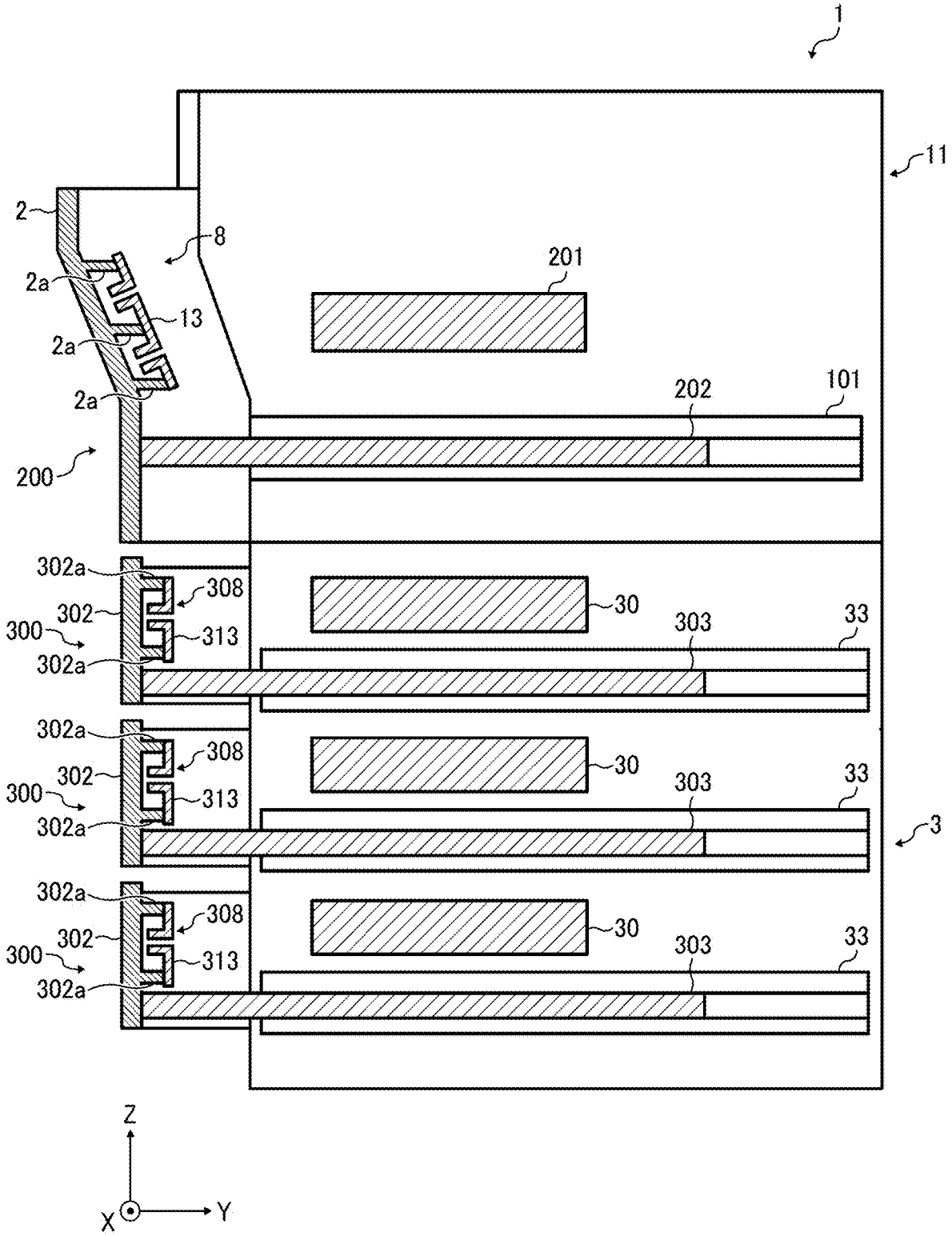
FIG. 15 is a diagram illustrating an aspect of the copier of FIG. 14 when the multiple drawers are drawn from the copier according to one embodiment of the present disclosure.

As shown in FIGS. 14 and 15, the copier 1 of this embodiment of the present disclosure employs multiple drawing units 200 and 300. That is, FIG. 14 is a diagram illustrating the multiple drawing units 200 and 300 when taken from a right side of the copier 1. FIG. 15 is a diagram illustrating one aspect of the copier 1 when all of the drawing units 200 and 300 is drawn a little from the apparatus frame 11 to the front side (i.e., on the left side in FIG. 14) of the apparatus frame 11. As shown in each of the drawings, hatching patterns are applied to the multiple drawing units 200 and 300 drawn from the apparatus frame 11 for a convenience, respectively.

Figure 16:
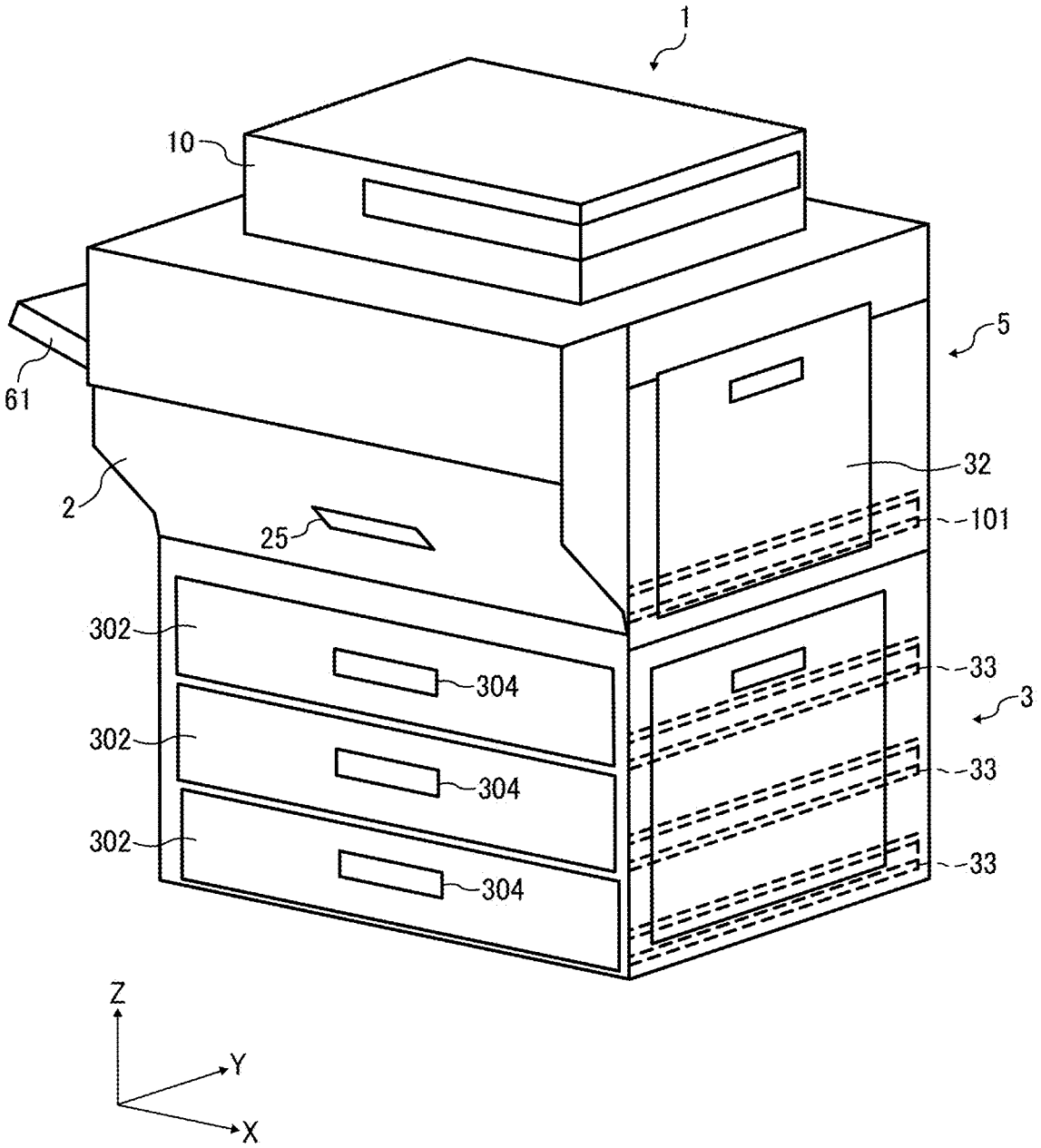
FIG. 16 is a perspective view schematically illustrating a modification of the copier shown in FIG. 3, in which multiple front external handles and guiding rails are added to the copier of FIG. 3 according to one embodiment of the present disclosure.

FIG. 16 also illustrates the copier 1 that additionally includes multiple pairs of guiding rails 101 and 33 to guide multiple drawers as shown by dashed lines, respectively, a front exterior handle 25 provided in the front exterior cover 2, and multiple sheet cassette exterior handles 304 provided in sheet cassette exterior covers 302, respectively.

As shown there, the copier 1 has one transfer section drawing unit 200 and three sheet cassette drawing units 300.

The transfer section drawing unit 200 integrally holds the front exterior cover 2, a recording medium transfer unit 201, and a pair of transfer section sliding rails 202 together, and is detachably attached to the apparatus frame 11. The pair of pair of transfer section sliding rails 202 is extended in a depth direction of the copier 1 (i.e., a direction parallel to a coordinate axis Y in the drawing). A pair of transfer section guiding rails 101 is also extended in the apparatus frame 11 in the depth direction and is fixed to the apparatus frame 11. The pair of transfer section guiding rails 101 holds the pair of transfer section sliding rails 202 in the depth direction of the copier 1, respectively.

The pair of transfer section sliding rails 202 is disposed in both ends of the front exterior cover 2 in a widthwise direction thereof (i.e., a horizontal direction and a direction parallel to a coordinate axis X in the drawing), respectively. The pair of transfer section guiding rails 101 is also provided in both ends of the apparatus frame 11 in the widthwise direction thereof (i.e., a horizontal direction and a direction parallel to the coordinate axis X in the drawing), respectively. Hence, when an operator holds the front exterior handle 25 disposed in the front exterior cover 2 and draws the front exterior cover 2 at a front side of the copier 1 (i.e., on the left side in FIG. 14), the transfer section drawing unit 200 moves horizontally along the pair of transfer section guiding rails 101. Subsequently, as shown in FIG. 15, the transfer section drawing unit 200 is drawn from the apparatus frame 11 to the front side of the apparatus frame 11. Hence, when the transfer section drawing unit 200 is further drawn from a state as shown in FIG. 15, a recording medium transfer unit 201 installed in the apparatus frame 11 can be exposed.

The recording medium transfer unit 201 includes the intermediate transfer belt 44, the primary transfer rollers 55, the secondary transfer device 52, the fixing unit 53, and the main sheet conveying path 70. Hence, by drawing out the transfer section drawing unit 200 and exposing the recording medium transfer unit 201, various members provided in the recording medium transfer unit 201 can be readily maintained and sheet jams caused on a sheet conveying path between the fixing unit 53 and the main sheet conveying path 70 can be quickly removed as well.

As described earlier, since the front exterior cover 2 as the molded product includes the pair of ribs 2*a*, the sound absorber 8 utilizing the Helmholtz resonator is obtained by combining the front exterior cover 2 with the top surface forming member 13 as a sheet metal having the opening. The front exterior cover 2 is either opened or closed along the pair of transfer section guiding rails 101. The bottom surface 84 of the sound absorber 8 provided in the front exterior cover 2 is inclined with respect to the pair of transfer section guiding rails 101.

Since the recording medium transfer unit 201 is placed in the copier 1 on the inner side of the front exterior cover 2 having the sound absorber 8, driving sound generated by various devices when executing a recording medium transfer process is absorbed by the sound absorber 8, thereby reducing leakage of sound to an outside of the apparatus frame 11. Here, a gap is generally formed between the front exterior cover 2 acting as an openable cover and another unopenable exterior member disposed adjacent to the front exterior cover 2 to prevent interference therebetween possibly caused during opening and closing operation of the front exterior cover 2. However, when the sound occurring in the copier 1 passes through the gap, it raises a problem of leakage of sound. However, by disposing the sound absorber 8 on the inner side of the front exterior cover 2 that causes the gap, the copier 1 can absorb the sound heading from a sound source inside the copier 1 to the gap. Hence, the leakage of sound through the gap formed between the front exterior cover 2 and the other exterior member (e.g., the unopenable exterior member) can be minimized.

Each of the sheet cassette drawing units 300 integrally holds a sheet cassette exterior cover 302, a sheet cassette 30 and a pair of sheet cassette sliding rails 303. Each of the sheet cassette drawing units 300 is detachably attached to the sheet feeding unit 3 of the apparatus frame 11. Further, each of the sheet cassette sliding rails 303 is extended in the depth direction of the copier 1 (i.e., in the direction parallel to the coordinate axis Y in the drawing). In the sheet feeding unit 3 of the apparatus frame 11, multiple pairs of sheet cassette guiding rails 33 are extended in the depth direction of the apparatus frame 11 and are fixed to the apparatus frame 11. Each of the pairs of the sheet guiding rails 33 holds a corresponding pair of sheet cassette guiding rails 33 in the depth direction of the copier 1 (i.e., the apparatus body), respectively.

The pair of sheet cassette sliding rails 303 is disposed in both ends of each of the sheet cassette exterior covers 302 in a widthwise direction thereof (i.e., either a horizontal direction (from the left to the right) of the apparatus body or a direction parallel to the coordinate axis X in the drawing), respectively. The multiple pairs of the sheet cassette guiding rails 33 are vertically arranged at both ends of the sheet feeding unit 3 of the apparatus frame 11 in the width direction thereof (i.e., from the left to the right in the apparatus frame 11 or the direction parallel to the coordinate axis X in the drawing), respectively, almost corresponding to the three sheet cassette drawing units 300.

Herein below, one of the sheet cassette drawing units 300 and the above-described various components thereof are typically described for convenience. Hence when an operator holds the sheet cassette exterior handle 304 provided in the sheet cassette exterior cover 302 and draws the sheet cassette exterior cover 302 at the front side of the copier 1 (i.e., on the left side in FIG. 14), the sheet cassette drawing unit 300 moves horizontally along the pair of sheet cassette guiding rails 33. Subsequently, as shown in FIG. 15, the sheet cassette drawing unit 300 is further drawn from the sheet feeding unit 3 of the apparatus frame 11 to the front side of the sheet feeding unit 3. Hence, when the sheet cassette drawing unit 300 in a state as shown in FIG. 15 is continuously drawn, the sheet cassette 30 installed in the apparatus frame 11 can be exposed. Accordingly, when it is exposed in this way, the sheet cassette 30 can be replenished with a new sheet bundle.

Further, as shown in FIG. 15, similar to the pair of ribs 2*a* employed in the front exterior cover 2, a sheet cassette exterior rib 302*a* as a plastic mold product is provided in the sheet cassette exterior cover 302 (i.e., on a back side thereof) as well. Similar again to the top surface forming member 13, by combining a sheet cassette opening forming member 313 made of a sheet metal to form an opening therein with the sheet cassette exterior cover 302 having the sheet cassette exterior rib 302*a*, a sheet cassette sound absorber 308 utilizing the Helmholtz resonator is configured. As described earlier, the sheet cassette exterior cover 302 is opened and closed when drawn and moved along the pair of sheet cassette guiding rails 33. A bottom of the sheet cassette sound absorber 308 provided in the sheet cassette exterior cover 302 intersects the pair of sheet cassette guiding rails 33 at a right angle.

More specifically, as shown in FIGS. 14 and 15, a sheet cassette opening surface forming member 313 is placed on a back side of the sheet cassette exterior cover 302 via a space. The sheet cassette sound absorber 308 is formed between the sheet cassette exterior cover 302 and the sheet cassette opening surface forming member 313 by utilizing the space as a cavity of the Helmholtz resonator. In this way, the sheet cassette exterior cover 302 is partially configured as a double layered structure composed of two overlaid planar members (i.e., the sheet cassette exterior cover 302 and the sheet cassette opening surface forming member 313), and utilizes the space between these two planar members as the cavity of the Helmholtz resonator. However, the sheet cassette exterior cover 302 is not limited to the double layered structure, and can be a multiple layered structure more than a triple layered structure. In addition, the sheet cassette exterior cover 302 is not limited to a type that partially includes the multilayered structure, and can be a type that entirely includes the multilayered structure.

The sheet cassette 30 of the copier 1 is placed inside the sheet cassette exterior cover 302 having the sheet cassette sound absorber 308. Multiple members are also arranged inside the sheet cassette exterior cover 302 to collectively feed sheets from the sheet cassette 30 as well. Because of this, driving sound generated by each of the multiple members when these sheets are fed can be absorbed by the sheet cassette sound absorber 308, thereby enabling to reduce leakage of the driving sound to the outside of the copier 1.

Further, to prevent interference between the sheet cassette exterior cover 302 acting as an opening cover and the other exterior member placed next to the sheet cassette exterior cover 302, which is unmovable (i.e., unopenable) together with the sheet cassette exterior cover 302 during opening and closing operation of the sheet cassette exterior cover 302, a gap is generally employed. In such a situation, when sound generated by a sound source in the sheet feeding unit 3 passes through the gap, it causes leakage of sound. However, according to this embodiment of the present disclosure, by disposing the sound absorber 308 inside the sheet cassette exterior cover 302, the copier 1 can absorb the sound even if the sheet cassette exterior cover 302 causes the gap and the sound heads the gap from the sound source. Hence, the leakage of sound through the gap formed between the sheet cassette exterior cover 302 and the other exterior member can be effectively suppressed again.

Further, these transfer section drawing unit 200 and the transfer section drawing units 300 include the recording medium transfer unit 201 and the sheet cassettes 30, respectively, and accordingly each have a certain amount of weight. In such a situation, when strength of each of such exterior covers 2 and 302 of the drawing units 200 and 300 with the respective handles 25 and 304 is insufficient to withstand a force applied to each of the handles 25 and 304, each of these exterior covers 2 and 302 is likely to be either damaged or deformed.

In this embodiment of the present disclosure, to enhance the strength of (i.e., reinforce) each of the exterior covers 2 and 302 thereby preventing such a problem, each of the multiple pairs of ribs 2*a* and 302*a* stands from inner surfaces of the exterior covers 2 and 302, respectively. With such configurations (i.e., the exterior covers 2 and 302 thickened by standing the multiple pairs of ribs 2*a* and 302*a* or the like, respectively), the sound absorbers 8 and 308 are prepared by utilizing the gaps between each of the pairs of ribs 2*a* and 302*a* as the cavities of the Helmholtz resonators. Hence, with this configuration, the sound absorbers 8 and 308 can be partially installed within a range of a thickness of the sound absorbers 8 and 308, and accordingly the image forming apparatus equipped with the sound absorbers 8 and 308 can be downsized.

Further, the front exterior handle 25 and the sheet cassette exterior handles 304 have shapes dented into an interior of the apparatus frame 11 from the exterior surfaces of the front exterior cover 2 and the sheet cassette exterior covers 302, respectively. However, these handles 25 and 304 are not limited to having such shapes dented from the exterior surfaces of these exterior covers 2 and 302 and may have shapes protruding to an outside of the apparatus frame 11 from the exterior surfaces of these exterior covers 2 and 302, respectively.

In other words, when viewed from inner wall surfaces of these exterior covers 2 and 302, the front exterior handle 25 and the sheet cassette exterior handles 304 dented into the interior of the apparatus frame 11 from the exterior surfaces of the front exterior cover 2 and the sheet cassette exterior covers 302 respectively project into the interior of the apparatus frame 11 in a direction of a thickness of each of these exterior covers 2 and 302. In view of this, to avoid (interference with projections of) these handles 25 and 304, the sound absorbers 8 and 308 are placed at prescribed positions on the inner wall surfaces of the exterior covers 2 and 302 holding the handles 25 and 304, respectively. As a result, these exterior covers 2 and 302 are not upsized in the direction of the thickness of each of the exterior covers 2 and 302 (i.e., not thickened) thereby being able to downsize the copier 1.

Further, as shown in FIG. 13, a mesh portion 26 composed of multiple holes is included in the inner wall surface of the front exterior cover 2 on the interior side of the apparatus frame 11 opposed to the front exterior handle 25 to take in air into the apparatus frame 11 from outside thereof through a space provided in the front exterior handle 25 to insert a hand. By disposing the mesh portion 26 in the front exterior cover 2 to take in the air into the apparatus frame 11 from outside thereof, efficiency of cooling the apparatus frame 11 heated up during operation thereof can be improved. In addition, since it is included in the front exterior handle 25 dented toward the interior of the apparatus frame 11 from the exterior surface of the front exterior cover 2, the mesh portion 26 is hardly visible in appearance of the copier 1, thereby being able to prevent degradation of the beauty of the copier 1. In addition, due to the placement of the sound absorbers 8 and 308 at the prescribed position on the inner wall surfaces of the exterior covers 2 and 302 holding the handles 25 and 304 to avoid (interference with projections of) these handles 25 and 304, respectively, the front exterior cover 2 and the sheet cassette exterior covers 302 are not upsized in a direction of a thickness of each of the front exterior cover 2 and the sheet cassette exterior covers 302 thereby being able to downsize the copier 1 even accommodating the sound absorbers 8 and 308.

As described heretofore, in particular with reference to FIGS. 13 to 16, in the copier 1, the sound absorbers 8 and 308 are disposed in the exterior covers 2 and 302 that cover one end of each the drawing units 200 and 300 in a drawing direction. The recording medium transfer unit 201 and the sheet cassettes 30 are disposed inside the exterior covers 2 and 302, respectively. However, what to install inside the exterior covers 2 and 302 including the sound absorbers 8 and 308, respectively, are not limited to these recording medium transfer unit 201 and the sheet cassettes 30 and may be, for example, a tandem image forming unit 50 to form an image on a photoconductor 74. In such a situation, with the sound absorber 8 disposed in the exterior cover 2, driving sound generated by component members of the tandem image forming unit 50 to collectively form the image can be absorbed and can be inhibited to leak to the outside of the copier 1.

Further, as shown in FIGS. 13 to 16, the sound absorber 8, in which at least one of the top surface 83 and the bottom surface 84 is inclined with respect to the side wall surface 85, is disposed in the front exterior cover 2 of the copier 1. As also described hereto fore with reference to FIGS. 13 to 16, the front exterior cover 2 is fixed to the drawing unit to either cover or expose parts installed in the copier 1 when either inserted into or drawn from the apparatus frame 11 of the copier 1. However, the openable cover is not limited to the above-described drawing unit 200, and can be a cover, for example, to open and close the parts installed in the copier 1 by pivoting on a rotary axis provided in the image forming apparatus (i.e., the copier 1) as described below.

Figure 17:
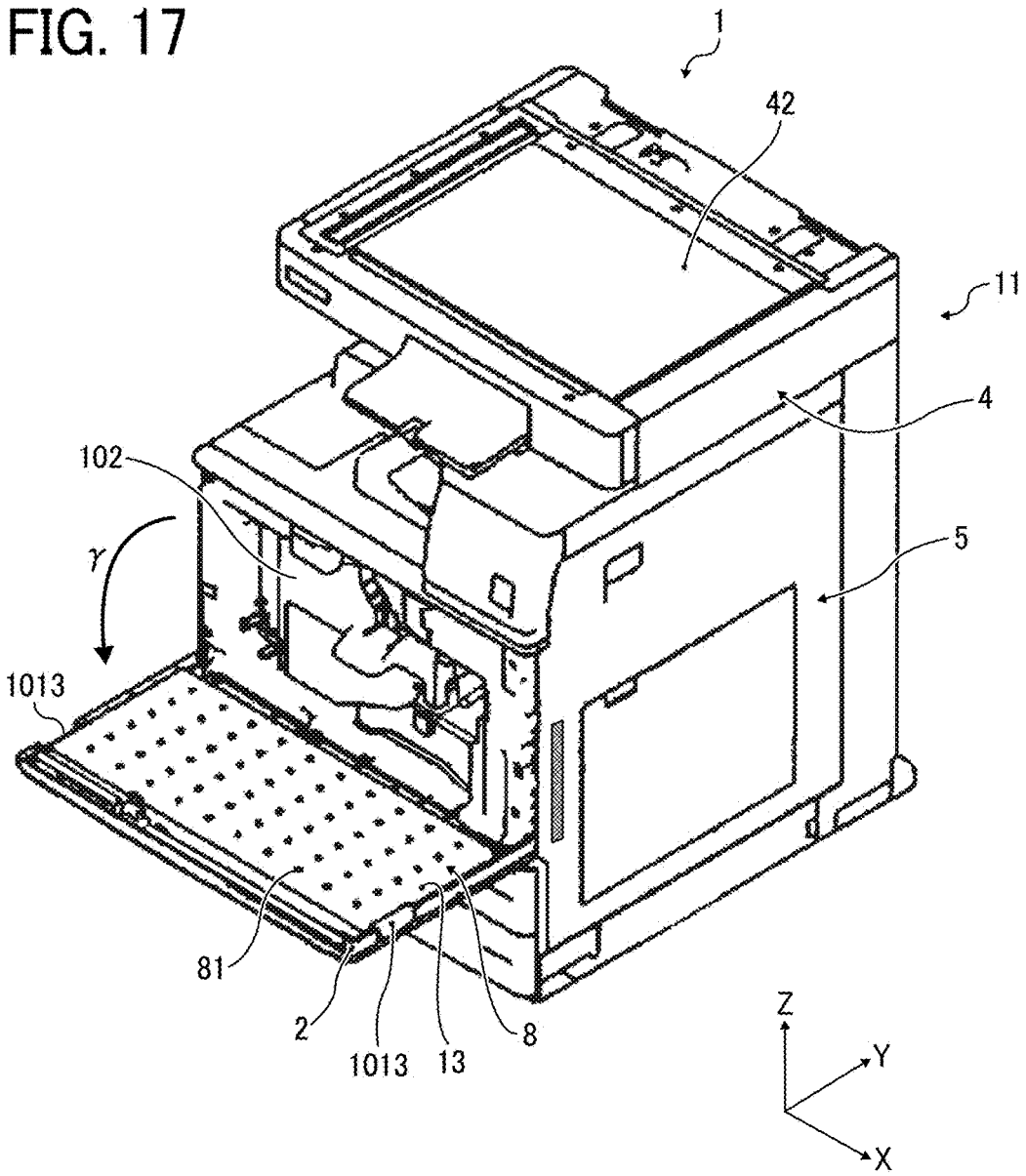
FIG. 17 is a perspective view schematically illustrating another copier with a front exterior cover of a swinging type according to one embodiment of the present disclosure.

That is, FIG. 17 is a perspective view schematically illustrating a copier 1 including a front exterior cover 2 pivotable on a rotary axis. As shown there, in the copier 1, the front exterior cover 2 pivots on the rotary axis located at the bottom of the front exterior cover 2. The front exterior cover 2 partially has a multilayered structure again prepared by piling up several sheets of plate members (i.e., the front exterior cover 2 and the top surface forming member 13). Hence, a space is formed between the front exterior cover 2 and the top surface forming member 13 to be used as the cavity of the Helmholtz resonator to produce the sound absorber 8.

In such a copier 1, as shown in FIG. 17, a pair of knobs 1013 is attached to sides of the front exterior cover 2 in its widthwise direction (i.e., in a direction parallel to the coordinate axis X in FIG. 17). Hence, by holding at least one of the pair of knobs 1013 and pivoting the front exterior cover 2 in a closed state in a direction as shown by arrow y in FIG. 17, the front exterior cover 2 is opened as shown in FIG. 17. In this state, an inner cover 102 provided behind the front exterior cover 2 is exposed. Then, by removing the inner cover 102, an image forming unit, such as a photoconductor, etc., is exposed, the parts therein can be maintained.

Hence, in the copier 1 shown in FIG. 17, leakage of sound from a plane of the front exterior cover 2 can be effectively inhibited. Further, even in such a pivoting type front exterior cover 2, since the sound absorber 8, in which at least one of the top surface 83 and the bottom surface 84 is inclined with respect to the side wall surface 85, is disposed, a degree of freedom of layout of the inner parts can be improved again.

Hence, with the pivoting type front exterior cover 2 shown in FIG. 17, the inner parts to be maintained or the like needs to be drawn to the front side of the copier 1 after removing both the front exterior cover 2 and the inner cover 102. By contrast, with the drawing type front exterior cover 2 as described earlier with reference to FIGS. 13 to 16, only by drawing the front exterior cover 2 to the front side of the apparatus frame 11, the inner parts held by the drawing unit 300 to be maintained or the like can be directly accessed.

As described heretofore, in the various embodiments and modifications of the present disclosure, the image forming apparatus is exemplified as an electronic device that employs the sound absorber. However, the present disclosure can be applied to various electronic devices other than the image forming apparatus as long as the electronic devices include a sound source to generate sound during operation thereof and a sound absorbing system to absorb the sound outputted from the sound source.

The above-described embodiments of the present disclosure are just examples and each accomplish a specific effect per embodiment as described below.

According to one aspect of the present disclosure, a sound absorber, such as the sound absorber 8, includes a cavity, such as the cavity 82, and a mouth, such as the mouth 81, to communicate the cavity with an outside of the sound absorber. The cavity includes a top surface, such as the top surface 83, a bottom surface, such as the bottom surface 84, and a side wall surface, such as the side wall surface 85. The top surface includes the mouth. The bottom surface opposes the top surface. The side wall surface is extended to connect the top surface with the bottom surface. At least one of the top surface and the bottom surface is inclined with respect to the side wall surface. According to the present aspect, as described in the above-described embodiment, the sound absorber can be placed at a position, at which the comparative example of the sound absorber cannot be placed. That is, in the comparative example of the sound absorber with a mouth and a cavity, the cavity is generally constructed such that the top surface and the bottom surface are parallel to each other, and the side wall surface is either cylindrical or polygonal prismatic and the like and perpendicular to both of the top surface and the bottom surface. In addition, since when a shape of the mouth is the same, as a volume of the cavity increases, a frequency of sound to be absorbed can be increasingly set to a low level. However, the volume of the cavity cannot be reduced anymore to absorb a prescribed frequency of the sound. For this reason, the sound absorber of the comparative example needs a prescribed cubic volume, and is only located at a position to be able accommodate the cavity that includes the side wall surface perpendicular to the top surface and the bottom surface. However, inventors of the present disclosure deliberately have considered and finally found out that as long as the cavity can ensure a prescribed volume, the sound absorber can absorb sound having a desired frequency even if a cavity is not cylindrical. That is, according to the first embodiment of the present disclosure, the sound absorber is configured such that at least one of the top surface and the bottom surface is inclined with respect to the side wall surface, and a cavity is not cylindrical. Such a configuration allows the sound absorber to be placed at the position, at which the comparative example of the sound absorber cannot afford the volume of the cavity and is not placed. Accordingly, the flexibility of placement of the sound absorber is effectively improved when compared with the comparative sound absorber.

According to another aspect of the present disclosure, an opening direction of the mouth, such as the mouth 81, is inclined with respect to a direction in which the side wall surface, such as the side wall surface 85, extends (e.g., the up-and-down direction in FIG. 1). With such a configuration, as described above, the mouth, such as the mouth 81, can be directed to the sound source, such as the drive motor 9, etc., located at a position inclined with respect to the direction in which the side wall surface extends, thus allowing improvement of sound absorbing performance of the sound absorber.

According to yet another aspect of the present disclosure, in the sound absorber, the top surface, such as the top surface 83, is inclined with respect to the bottom surface, such as the bottom surface 84. With such a configuration, as described above, the freedom of the arrangement of the sound absorber of this aspect is improved more than the sound absorber in which the top surface and the bottom surface are disposed in parallel to each other.

According to yet another aspect of the present disclosure, in the sound absorber, the top surface, such as the top surface 83, is parallel to the bottom surface, such as the bottom surface 84. As described above, the configuration in which the top surface and the bottom surface are inclined with respect to the side wall surface, such as the side wall surface 85, allows the sound absorber to be disposed at a position at which the sound absorber of the comparative example cannot accommodate the volume of the cavity and be disposed.

According to yet another aspect of the present disclosure, in the sound absorber, the cavity, such as the cavity 82, is constituted by a plurality of members, such as the top surface forming member 13 and the cavity forming member 14, made of materials having different densities from each other. With such a configuration, as described above, the sealability of the cavity can be effectively ensured.

According to yet another aspect of the present disclosure, in the sound absorber, the density of a material of one member, such as the top surface forming member 13, of the plurality of members making the top surface, such as the top surface 83, is higher than the density of a material of another member, such as the cavity forming member 14, of the plurality of members making the cavity, such as the cavity 82. With such a configuration, as described above, the transmission of the sound can be suppressed, thereby improving sound absorbing performance.

According to yet another aspect of the present disclosure, in the sound absorber, the top surface member, such as the top surface forming member 13, making the top surface, such as the top surface 83, is made of metal, and the mouth, such as the mouth 83, has a flange, such as the flange 131. With such a configuration, as described above, by making the top surface forming member with metal having higher density than resin, the sound transmission can be effectively suppressed. In addition, by establishing the standing up construction, the mouth is elongated, a sound absorbing frequency can be set to a low level at the same time.

According to yet another aspect of the present disclosure, in the sound absorber, the flange, such as the flange 131, is produced by drawing, such as burring. With such a configuration, as described above, a separate member is not needed to be additionally attached to a part of the wall surface of the cavity, such as the cavity 82, to produce the mouth, such as the mouth 81. In addition, the strength of the mouth can be upgraded by using a drawing process.

According to yet another aspect of the present disclosure, in the sound absorber, the flange, such as the flange 131, projects perpendicular to the top surface. With such a configuration, as described above, a direction of the mouth, such as the mouth 81, can be set perpendicular to the top surface 83, such as the top surface 83. In addition, as long as the direction is perpendicular to the top surface, the standing up construction can be established at low cost.

According to yet another aspect of the present disclosure, in the sound absorber, the flange, such as the flange 131, is located within the cavity, such as the cavity 82. With such a configuration, as described above, the sound absorbing frequency can be set to a low level, and the standing up construction does not disturb an operator during assembly and maintenance thereof.

According to yet another aspect of the present disclosure, in the sound absorber, the top surface, such as the top surface 83, is formed by the top surface forming member, such as the top surface forming member 13. The top surface forming member includes a surface having a different angle from an angle of the top surface. With such a configuration, as described above, the rigidity of the top surface forming member can be effectively upgraded.

According to yet another aspect of the present disclosure, in the sound absorber, the top surface is formed by the top surface forming member, such as the top surface forming member 13. The top surface forming member includes bent portions, such as the bent portions 13*b*, at two opposite edges of the top surface forming member across the mouth. The bent portions are bent perpendicular to the top surface. With such a configuration, as described above, the rigidity of the top surface forming member can be more effectively upgraded.

According to yet another aspect of the present disclosure, in the sound absorber, the bent portions, such as the bent portions 13*b*, are extended in a longitudinal direction of the top surface forming member, such as the top surface forming member 13. With such a configuration, as described above, the deflection of the top surface forming member in the longitudinal direction can be suppressed while compensating a lack of strength in the longitudinal direction at the same time.

According to yet another aspect of the present disclosure, in the sound absorber, the cavity, such as the cavity 82, is constituted by a plurality of members, such as the top surface forming member 13 and the cavity forming member 14, and the plurality of members is fastened to each other by using a screw. With such a configuration, as described above, the sealability of the cavity can be ensured by using a fastening screw.

According to yet another aspect of the present disclosure, in the sound absorber, an axial direction of the screw fastened to the plurality of members is parallel to the side wall surface. Accordingly, a screw hole (e.g., the screw hole 14*a*), such as a prepared screw hole, can be formed at the same time when an injection molding process is executed by using a mold.

According to yet another aspect of the present disclosure, an electronic device, such as the copier 1, includes the sound absorber, such as the sound absorber 8, and a frame, such as the apparatus body or frame 11, to accommodate the electronic device. The sound absorber absorbs sound generated during operation of the electronic device. With such a configuration, as described above, a space to install the sound absorber can be readily obtained in an electronic device, and sound generated during operation of the electronic device can be more effectively absorbed.

According to yet another aspect of the present disclosure, in the electronic device, the side wall surface, such as the side wall surface 85, is a surface of an exterior cover of the electronic device. The cavity forming member, such as the cavity forming member 14, is not separately needed beside the exterior cover. With such a configuration, as described above, the electronic device, such as the copier 1, can be compact and lightweight, this reducing the number of parts and cost as well.

According to yet another aspect of the present disclosure, the electronic device, such as the copier 1, further includes the frame, such as the apparatus frame 11, a drawing unit, such as the drawing unit 200, withdrawably inserted in the frame, and a drawing unit exterior member, such as the front exterior cover 2, constituting part of an exterior of the electronic device, to cover a front end of the drawing unit in a direction in which the drawing unit is drawn. The drawing unit exterior member includes the sound absorber. With such a configuration, as described above, the sound absorber can be partially installed within a range of a thickness of the drawing unit exterior cover, and accordingly the image forming apparatus equipped with the sound absorber can be downsized.

According to yet another aspect of the present disclosure, the electronic device further includes the frame, such as the apparatus frame 11, and an exterior swinging member, such as the front exterior cover 2, to pivot on a rotary axis to open and close the frame. The exterior swinging member includes the sound absorber, such as the sound absorber 8. With such a configuration, as described above, in the electronic device, such as the copier 1, sound leaking from a plane of the front exterior cover can be effectively reduced.

According to yet another aspect of the present disclosure, an electronic device, such as the copier 1, includes a frame, such as the apparatus frame 11, and a sound absorber, such as the sound absorber 8 or the sound absorber 308, to absorb sound generated in the electronic device. The sound absorber includes a cavity, such as the cavity 82, and the mouth, such as the mouth 81, to communicate the cavity with an outside of the electronic device. A drawing unit, such as the drawing unit 200 or the drawing unit 300, withdrawably inserted in the frame is provided in the electronic device. A drawing unit exterior member, such as the front exterior cover 2 or the sheet cassette exterior cover 302, having a multilayered structure is also provided in the electronic device constituting part of an exterior of the electronic device, to cover a front end of the drawing unit in a direction in which the drawing unit is drawn. The cavity of the sound absorber is disposed in the multilayered structure of the drawing unit exterior member. With such a configuration, as described above, the sound absorber can be partially installed within a range of a thickness of the drawing unit exterior cover, and accordingly the image forming apparatus equipped with the sound absorber can be downsized.

According to yet another aspect of the present disclosure, an image forming apparatus, such as the copier 1, includes at least one image forming unit, and the at least one image forming unit includes the electronic device. With such a configuration, as described above, the space to install the sound absorber is easily obtained in the image forming apparatus, and the sound generated during the operation of the image forming apparatus can be more effectively absorbed.

Numerous additional modifications and variants of the present disclosure are possible in light of the above teachings. It is therefore to be understood that within the scope of the appended claims, the present disclosure may be practiced otherwise than as specifically described herein. For example, the sound absorber is not limited to the above-described various embodiments and modifications may be made as appropriate. Further, the electronic device is not limited to the above-described various embodiments and modifications may be altered as appropriate as well. Further, the image forming apparatus is not limited to the above-described various embodiments and modifications may be altered as appropriate as well.

What is claimed is:

1. A sound absorber comprising:

a first portion having a flat shape and including an opening therein directed to a sound source;

a flange projecting from the first portion toward an inside or outside of a cavity, the flange defining the opening in the first portion;

a second portion having a flat shape and opposing the first portion; and a plurality of side walls connecting the first portion and the second portion such that the first portion, the second portion, and the plurality of side walls surround the cavity, wherein the plurality of side walls includes two side walls opposing each other in a vertical cross section of the first portion, each of the two side walls extends straight from the second portion to the first portion in the vertical cross section of the first portion, the flange being inclined relative to the two side walls, and the flange being inclined relative to both the first portion and the second portion such that a line extending from a center of the opening defined by the flange towards the cavity is offset from a center of the second portion in a direction towards an intersection between the second portion and a lower one of the two side walls.

2. The sound absorber according to claim 1, wherein the two side walls are inclined with respect to the first portion and the second portion.

3. The sound absorber according to claim 2, wherein a distance between the two side walls associated with the cavity is same from the first portion to the second portion while the two side walls are inclined with respect to the first portion and the second portion.

4. The sound absorber according to claim 1, wherein the first portion, the second portion, and the plurality of side walls are separate members from the sound source.

5. The sound absorber according to claim 1, wherein the two side walls are made of resin.

6. An electronic device comprising:

the sound absorber according to claim 1 configured to absorb sound; and the sound source configured to generate the sound.

7. The electronic device according to claim 6, wherein the second portion is an exterior cover of the electronic device.

8. The electronic device according to claim 7, wherein the exterior cover is an openable cover configured to open and close an inside of the electronic device.

9. The electronic device according to claim 6, further comprising:

a frame;

a drawing unit withdrawably inserted in the frame; and a drawing unit exterior member, the drawing unit exterior member being part of an exterior of the electronic device and including the sound absorber, the drawing unit exterior member configured to cover a front end of the drawing unit in a direction in which the drawing unit is drawn.

10. An image forming apparatus comprising:

the electronic device according to claim 6.

11. The sound absorber according to claim 1, wherein the top surface, the bottom surface and the at least one side wall are a plurality of discrete elements fastened to each other.

12. The sound absorber according to claim 1, wherein the flange being inclined relative to both the first portion and the second portion such that the flange is inclined towards the intersection between the second portion and the lower one of the two side walls.

* * * * *